US011781359B2

(12) United States Patent
Bacchetti

(10) Patent No.: US 11,781,359 B2
(45) Date of Patent: Oct. 10, 2023

(54) SMALL BULKINESS HINGE

(71) Applicant: IN & TEC S.R.L., Brescia (IT)

(72) Inventor: Luciano Bacchetti, Nave (IT)

( * ) Notice: Subject to any disclaimer, the term of this patent is extended or adjusted under 35 U.S.C. 154(b) by 119 days.

(21) Appl. No.: 17/620,683

(22) PCT Filed: Jul. 3, 2020

(86) PCT No.: PCT/IB2020/056291
§ 371 (c)(1),
(2) Date: Dec. 18, 2021

(87) PCT Pub. No.: WO2021/001797
PCT Pub. Date: Jan. 7, 2021

(65) Prior Publication Data

US 2022/0356740 A1 Nov. 10, 2022

(30) Foreign Application Priority Data

Jul. 3, 2019 (IT) ..... 102019000010818
Jul. 3, 2019 (IT) ..... 102019000010821
Jul. 3, 2019 (IT) ..... 102019000010824

(51) Int. Cl.
*E05F 3/20* (2006.01)
*E05F 1/12* (2006.01)
*E05F 3/10* (2006.01)

(52) U.S. Cl.
CPC ..... *E05F 1/1253* (2013.01); *E05F 3/104* (2013.01); *E05F 3/20* (2013.01); *E05Y 2201/11* (2013.01)

(58) Field of Classification Search
CPC ..... E05F 1/1253; E05F 3/104; E05F 3/20; E05Y 2201/11
See application file for complete search history.

(56) References Cited

U.S. PATENT DOCUMENTS 1,603,823 A * 10/1926 Willard ..... E05F 1/1253 16/284
7,305,796 B2 * 12/2007 Chiang ..... E05F 1/1253 16/255
8,528,169 B1 * 9/2013 Yu ..... E05F 3/20 16/238

(Continued)

FOREIGN PATENT DOCUMENTS

WO 2016185394 11/2016

*Primary Examiner* — Jason W San
(74) *Attorney, Agent, or Firm* — Themis Law

(57) ABSTRACT

A low-bulkiness hinge for closing a closing element anchored to a stationary support structure, such as a wall, a frame or a floor includes a hinge body which includes a longitudinal operating chamber defining a first axis, a pivot coupled to the hinge body to rotate around a second axis between the opening and closing positions of the closing element, and a slider slidable in the operating chamber along the first axis. The operating chamber has a first seat for the pivot and a second seat for the sliding of the slider, which includes a shaft and an operative head that are mutually coupled. The hinge body has a first opening for inserting, perpendicularly to the first axis, the operative head into the second seat and a second through opening for inserting, coaxially to the first axis, the shaft into the housing. The hinge further has the shaft and the operative head fixed to one another after insertion in the second seat (so as to form a unitary assembly integrally slidable along the first axis.

14 Claims, 17 Drawing Sheets

(56) References Cited

U.S. PATENT DOCUMENTS

| | | | | |
|---|---|---|---|---|
| 9,702,177 | B2 * | 7/2017 | Bacchetti | E05F 3/104 |
| 9,810,012 | B2 * | 11/2017 | Bacchetti | E05F 3/20 |
| 10,378,259 | B2 * | 8/2019 | Miglioranzo | E05F 1/105 |
| 10,422,175 | B2 * | 9/2019 | Bacchetti | E05F 3/104 |
| 10,633,903 | B2 * | 4/2020 | Benedetti | E05D 5/10 |
| 2007/0246945 | A1 * | 10/2007 | Chiang | E05D 7/081 292/92 |
| 2008/0127452 | A1 * | 6/2008 | Jackson | E05D 15/54 16/50 |
| 2011/0030167 | A1 * | 2/2011 | Chiang | E05F 3/104 16/78 |
| 2011/0197391 | A1 * | 8/2011 | Yu | E05F 3/104 16/49 |
| 2012/0117755 | A1 * | 5/2012 | Walhorn | E05F 3/104 16/50 |
| 2012/0117758 | A1 * | 5/2012 | Walhorn | E05F 1/1253 16/349 |
| 2012/0311817 | A1 * | 12/2012 | Bacchetti | E05F 3/04 16/49 |
| 2013/0185896 | A1 * | 7/2013 | Yu | E05F 3/226 16/55 |
| 2014/0075718 | A1 * | 3/2014 | Bacchetti | E05F 3/104 16/54 |
| 2017/0030124 | A1 * | 2/2017 | Bacchetti | E05F 3/104 |
| 2017/0030125 | A1 * | 2/2017 | Bacchetti | E05F 3/10 |
| 2018/0283073 | A1 * | 10/2018 | Bacchetti | E05F 1/105 |
| 2019/0203514 | A1 * | 7/2019 | Clark | E05D 11/1064 |
| 2020/0115943 | A1 * | 4/2020 | Bacchetti | E05F 1/1253 |
| 2021/0189782 | A1 * | 6/2021 | Benedetti | E05F 3/12 |
| 2021/0355730 | A1 * | 11/2021 | Miglioranzo | E05F 3/22 |
| 2022/0195770 | A1 * | 6/2022 | Benedetti | E05D 5/0246 |

* cited by examiner

SMALL BULKINESS HINGE

FIELD OF THE INVENTION

The present invention generally relates to the technical field of hinges for doors, shutters or the like, and in particular it relates to a small bulkiness hinge.

STATE OF THE ART

As known, hinges generally comprise a movable element, usually fixed to a door, a shutter or the like, hinged on a fixed element, usually fixed to the support frame of the latter.

In particular, the hinges usually used in cold stores or in the glass shutters are cumbersome, aesthetically wanting and poorly functional.

Furthermore, hinges in which the return of the shutter to the closed position is unopposed are known in such technical field. Thus, there is the risk of the shutter strongly abutting against the support frame, ending up damaged. Furthermore, such hinges generally have closing means to ensure the return of the shutter to the closed position, thus increasing the risk of damaging the shutter.

To this end, door closers which include hydraulic damping means for countering the action of the closing means are thus known. Such known devices have extremely large overall dimensions and, thus, must necessarily be mounted on the floor. Thus, it is clear that such door closers are not suitable for mounting in the stationary support structure or in the shutter of cold stores.

Italian patent 102015000015573 on behalf of the Applicant in question discloses a hinge provided with closing means and hydraulic damping means thereof. In particular, the hinge comprises a slider interacting with the rotation pivot to slide upon rotating the latter and a fixed support shaft.

Although having a relatively small thickness, such hinge has large overall dimensions, in particular as regards the length which jeopardises the use of the hinge in particular contexts in which minimum overall dimensions are required, such as the refrigeration industry.

SUMMARY OF THE INVENTION

An object of the present invention is to at least partly overcome the aforementioned drawbacks, by providing a hinge that is highly functional, easy to manufacture and inexpensive.

Another object of the invention is to provide a hinge having extremely small overall dimensions.

Another object of the invention is to provide a hinge having a particularly small length.

Another object of the invention is to provide a hinge that can be interposed between the shutter and the frame of the stationary support structure of a cold store.

Another object of the invention is to provide a hinge capable of guaranteeing the automatic closure of the door from the door open position.

Another object of the invention is to provide a hinge capable of guaranteeing the controlled movement of the door to which it is constrained, both during the opening and closure.

Another object of the invention is to provide a hinge that is capable of supporting doors, windows and shutters, even very heavy ones.

Another object of the invention is to provide a hinge that has a minimum number of components.

Another object of the invention is to provide an extremely safe hinge which does not resist closing if yanked.

Another object of the invention is to provide a hinge that is extremely easy to install.

These and other objects that will be more apparent hereinafter, are attained by a hinge according to what is described, illustrated and/or claimed herein.

Advantageous embodiments of the invention are defined according to the dependent claims.

BRIEF DESCRIPTION OF THE DRAWINGS

Further characteristics and advantages of the invention will be more apparent in light of the detailed description of a preferred but non-exclusive embodiment of a hinge 1, illustrated by way of non-limiting example with reference to the attached drawings, wherein.

DETAILED DESCRIPTION OF A PREFERRED EMBODIMENT

Figure 1A:
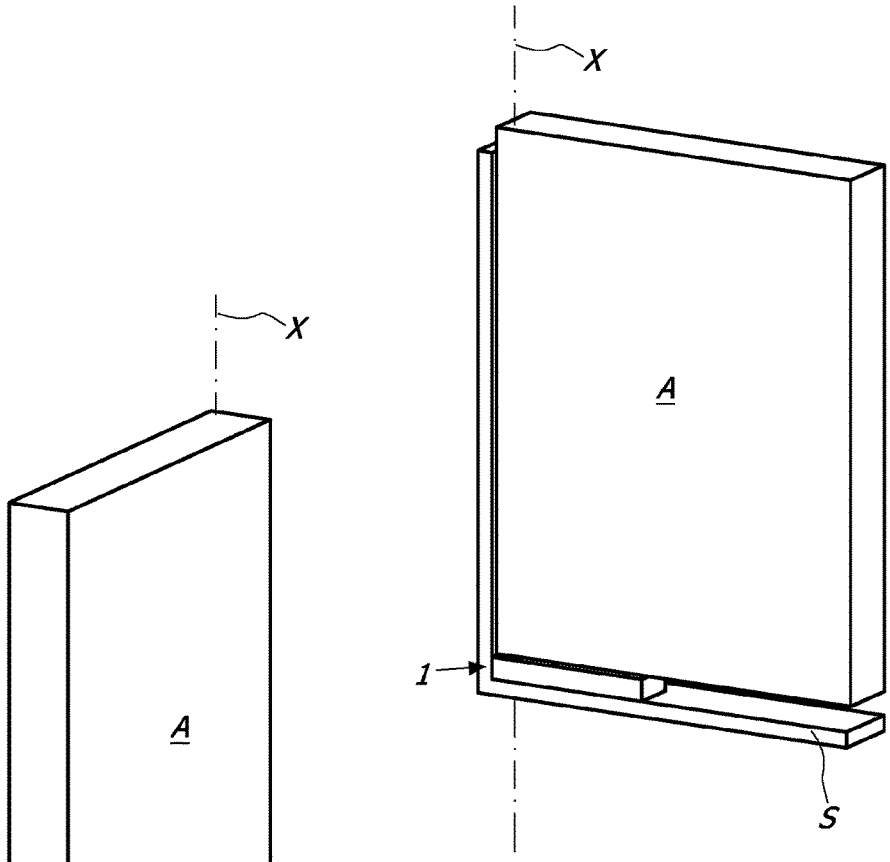
FIGS. 1A, 1B and 1C are schematic views of a hinge 1 coupled with a support structure S and a shutter A.
Figure 1B:
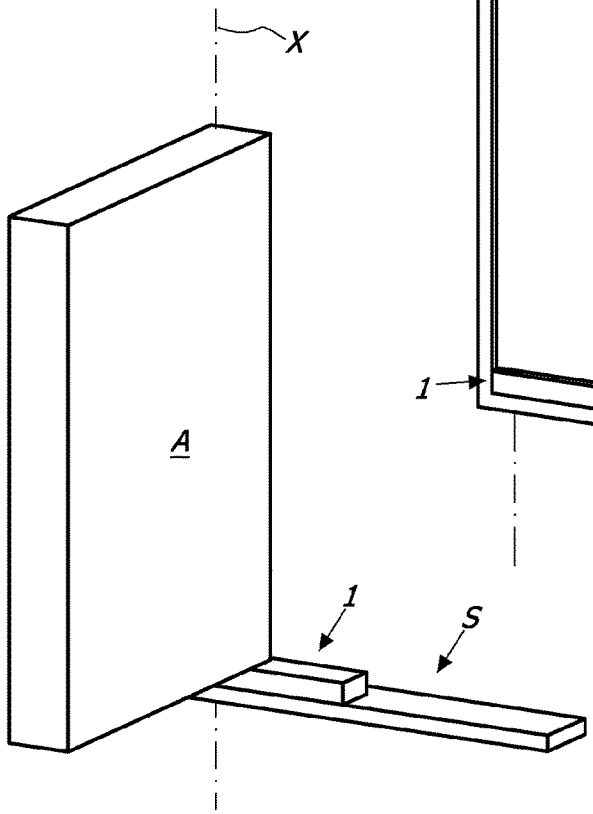
Figure 1C:
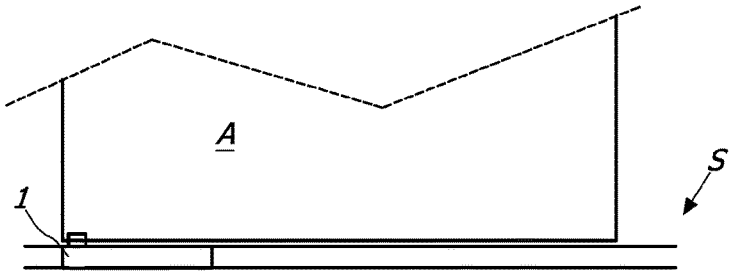
Figure 2A:
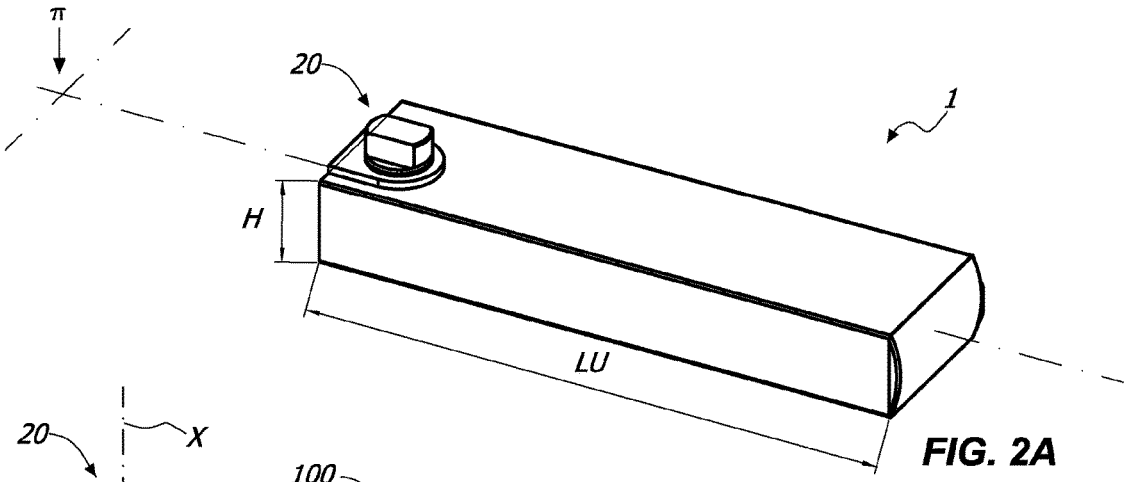
FIGS. 2A and 3A are axonometric views of a hinge 1 respectively in the shutter A closed and shutter A open at 90° position, with FIGS. 2B and 3B respectively showing a lateral view of FIGS. 2A and 3A.
Figure 2B:
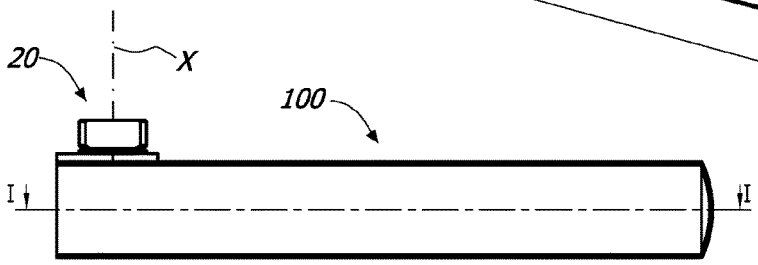
Figure 3A:
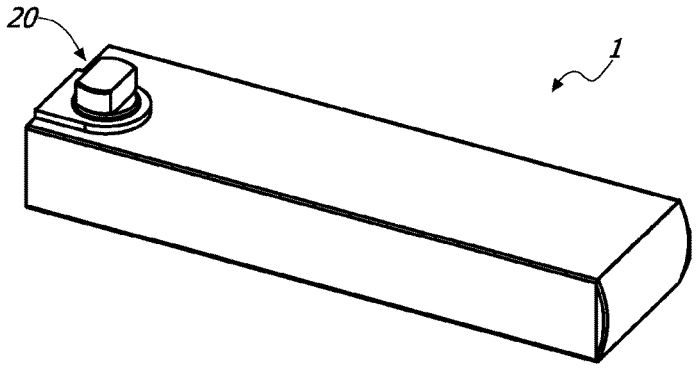
Figure 3B:
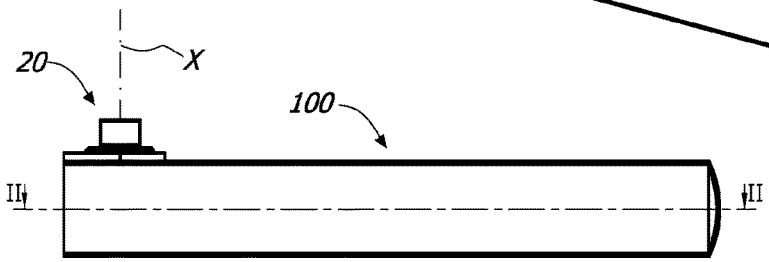

With reference to the aforementioned figures, the hinge according to the invention, indicated in its entirety with reference number 1, may have small overall dimensions, and it will therefore be advantageously usable in applications in which the space for inserting the hinge is limited or where—for aesthetic purposes—it is advisable to use a hinge with minimum overall dimensions. In particular, the hinge 1 may have a particularly small length LU.

Generally, the hinge 1 can be suitable to rotatably couple a stationary support structure, for example a tubular frame S, and a closing element, for example a shutter A, rotatably movable between an opening and a closing position around a rotation axis X.

It is clear that even though reference will be made hereinafter to the frame S and the shutter A, the hinge 1 can be applied to any stationary support structure and any closing element without departing from the scope of protection of the attached claims.

For example, the hinge 1 can be mounted on cold stores, or it can be integrated in the tubular frame thereof. In a further example, the hinge 1 may be mounted on glass shutters A, such as for example those of a glass showcase, or for glass shutters A or cold store doors.

Once assembled, the hinge 1 will appear as parallelepiped-shaped element which can possibly be inserted in the tubular frame of the shutter A or into the support structure S.

Suitably, the hinge 1 may include a hinge body 10 with elongated shape along an axis Y and a pivot 20 defining the rotation axis X. The latter may be substantially perpendicular to the axis Y.

Preferably, but not exclusively, the hinge body 10 may have a small thickness so as to be substantially plate-like so as to define a main plane n. Preferably, the hinge 1 may have a relatively low height H.

The hinge body 10 may be anchored to the shutter A and the pivot 20 to the frame S. In such case, the fixed element will include the pivot 20, while the movable element may include the hinge body 10.

On the other hand, the hinge body 10 may be anchored to the frame S, while the pivot 20 may be anchored to the shutter A, without departing from the scope of protection of the attached claims. In this case, the fixed element will include the hinge body 10, while the movable element may include the pivot 20.

Advantageously, the hinge body 10 and the pivot 20 may be mutually coupled to each other to rotate around the axis X between the positions for opening and closing the shutter A.

Hereinafter, reference will be made only to the rotation of the pivot 20, and in particular, reference will be made to a configuration in which the shutter A rotates between a closed position in which the pivot 20 is aligned along the axis Y and an open position in which the pivot 20 is rotated with respect to the same axis by 90°.

It is clear that this configuration is not exclusive. As a matter of fact, in a per se known manner, the position of the pivot 20 may correspond to a different position of the shutter A. For example, when the pivot 20 is aligned along the axis Y, the shutter A may be in the open position, while when the pivot 20 is rotated with respect to the axis by 90°, the shutter A may be in closed position.

A slider element 30 slidable along the Y axis between at least one stroke start position and one stroke end position may also be provided for. Suitably, the pivot 20 may include a cam element 21 integrally joined thereto interacting with a corresponding cam follower element 31 of the slider element 30 so that the rotation of the former corresponds to the sliding of the latter and vice versa.

Preferably, the shutter A closed position may correspond to the stroke end position of the slider element 30, while the shutter A open position may correspond to the stroke start position of the slider element 30.

Such embodiment is not exclusive. It is actually clear that, depending on the mutual configuration of the cam elements 21 and cam follower 31, the shutter A closed position may correspond to the stroke start position of the slider element 30, while the shutter A open position may correspond to the stroke end position of the slider element 30. In other words, the rotation of the pivot 20 between the shutter closed and shutter open positions may correspond to the sliding of the slider element 30 between the stroke start and stroke end position.

Advantageously, the cam elements 21 and cam follower 31 may be configured in a manner such that the slider element 30 slides from the stroke end position, i.e., the shutter closed position, to the stroke start position, i.e. the shutter open position, upon rotating the pivot 20 both clockwise and anti-clockwise.

Furthermore, the pivot 20 may be off-centred with respect to the hinge body 10, and in particular with respect to the width of the hinge body 10, as shown in the attached figures, or it may be in a central position. In other words, the rotation axis X may be staggered with respect to the median line of the hinge 1 or it may be arranged along the median line of the hinge and substantially perpendicular to the latter.

The hinge 1 may be an ambidextrous hinge.

The pivot 20 may comprise a surface 22 defining the cam means 21, while the slider element 30 may comprise an operative face 32 defining the cam follower means 31.

According to a particular preferred but non-exclusive embodiment, the operative face 32 of the slider element 30 may be substantially flat or slightly-shaped, while the surface 22 of the pivot may be substantially round.

Preferably, but not exclusively, the surface 22 may be substantially symmetrical with respect to the axis X so that the operative face 32 slides along the axis Y upon rotating the pivot 20 both in the clockwise and anticlockwise direction.

In any case, it is clear that this embodiment is not exclusive. As a matter of fact, the cam means 21 and cam follower means 31 may be any of the per se known type.

As a matter of fact, depending on the configuration thereof, the amount of sliding of the slider element 30 may be determined in response to the rotation of the pivot 20 and vice versa.

Possibly, according to a different embodiment not shown in the attached figures, the pivot 20 and the slider element 30 may be coupled by means of different systems, for example, a rack-and-pinion system of the per se known type may be provided for. Possibly, the pivot 20 and the slider element 30 may be integrally coupled.

The hinge 1 may therefore comprise an operative chamber 11. The operative chamber 11 may be substantially be parallelepiped-shaped. The operative chamber 11 may be inside the hinge 1. The operative chamber 11 may be delimited by one or more side walls 116 and by a pair of mutually facing and opposite bottom walls 112, 113.

Preferably, the cam means 21 and cam follower means 31 may be arranged in the operative chamber 11.

More in detail, the operative chamber 11 may comprise a seat 18 for the rotation of the pivot 20 and a seat 19 facing the seat 18 for the sliding of the slider element 30, as better explained hereinafter.

In particular, the hinge body 10 may have a longitudinal portion 14 and a pair of facing and spaced-apart portions 12, 13 extending from the longitudinal portion 14. Preferably, but not exclusively, the hinge body 10 may be substantially C-shaped.

The portion 13 may comprise the seat 18 for the pivot 20.

The pivot 20 may be inserted into the seat 18 in a per se known manner. Preferably, but not exclusively, the pivot 20 may be inserted along the axis X and means 25 for preventing the movement of the pivot 20 perpendicularly to such axis X once positioned in the seat 18 may be provided for.

On the other hand, as better explained hereinafter, the hinge body 10 may comprise one or more openings 118, 121 to allow the insertion of the slider 30 into the seat 19.

Suitably, each of the portions 12, 13, 14 of the hinge body 10 may comprise a respective inner surface 120, 130, 140. In other words, the surfaces 120, 130, 140 may define an inner surface 10" of the hinge body 10 and they may define one or more of the walls 116 of the operative chamber 11.

According to a particular aspect of the invention, the hinge 1 may comprise the hinge body 10 and a shell 100. Preferably, the latter may be mutually removably couplable.

Advantageously, in order to reduce the costs of the hinge 1, the hinge body 10 may be made of polymeric material, while the shell 100 may be made of metallic material.

In a preferred but non-exclusive embodiment, the shell 100 may be an elongated box-like body into which the hinge body 10 may be slidably insertable. It is clear that the hinge body 10 too may also be substantially parallelepiped-shaped.

Preferably, the shell 100 and the hinge body 10 may be removably coupled by mutually sliding along the axis Y or an axis parallel thereto.

In any case, means for mutually locking the hinge body 10 and the shell 100 in the operative position, i.e. once coupled, may be provided for. For example, one of the latter may have a locking projection or notches which are snap-inserted into the other of the hinge body 10 and the shell 100. Possibly, the locking means may comprise a closing cap 102 to prevent the axial sliding of the shell 100 and of the hinge body 10 along the axis Y.

Once coupled, the closing cap 102 can prevent the axial mutual sliding along the axis Y in one direction, while the projection can prevent axial mutual sliding along the axis Y in the opposite direction. The projection may be at the seat 18 for the pivot 20, or part of the pivot 20.

According to a particular aspect of the invention, means 108 for fixing the shell 100 to the frame S may be provided for. For example, the shell 100 may comprise a pair of through slots 109 to allow the fixing thereof to the frame S by means of screws in a per se known manner.

Suitably, the pivot 20 may then be firstly inserted into the seat 18 and the slider 30 into the seat 19 so that the latter, together with the hinge body 10, form a hinge assembly.

The hinge assembly 2 may then be subsequently mutually coupled with the shell 100, preferably the former may be inserted into the latter.

For example, the shell 100 may be fixed to the frame T, the hinge body 10 with the pivot 20 and the slider 30 may be inserted into the shell 100 and the shutter A may be coupled with the pivot 20. Furthermore, the shutter A may be de-coupled from the pivot 20, the hinge body 10 with the pivot 20 and the slider 30 may be removed from the shell 100, the hinge body 10 and/or the pivot 20 and/or the slider 30 may be repaired or replaced and the slider may be inserted into the shell 100, and the shutter A may be coupled to the pivot 20.

In this manner, the replacement and maintenance operations may be particularly simple and quick.

Various types of mechanical and/or hydraulic control of the hinge 1 will be better specified hereinafter.

The shell 100 may be a covering element, a wall, a planar element, or, preferably, a box-like shell which can therefore enclose the hinge body 10.

The box-like shell 100 may have a plurality of inner surfaces 104, 105, 106, 107 designed to remain facing or at contact with the hinge body 10.

Suitably one or more of the inner surfaces 104, 105, 106, 107 of the box-like shell 100 may be at contact with the outer surface 10' of the hinge body 10 and/or may cooperate with the latter to close the opening 118.

Generally, the shell 100 may be configured so that—upon coupling with the box-like body 10—the former closes the opening 118. In this manner, upon coupling the shell 100 with the box-like body 10, the operative chamber 11 may be substantially closed and may be delimited by a plurality of walls 116.

For example, as shown in the attached figures, at least one portion of one or more of the inner surfaces 105, 106, 107 of the box-like shell 100 may close the opening 118 thus defining one or more of the side walls 116 of the operative chamber 11. For example, as shown in the attached figures, the side walls 116 of the operative chamber 11 may be defined by the surface 140 of the portion 14 and by the inner surfaces 105, 106. 107 of the box-like shell 100.

It is clear that such embodiment is not exclusive. For example, the operative chamber 11 may be substantially parallelepiped-shaped, and it may comprise a single open side wall which can be closed by means of a planar element, a pair of opposite open side walls which can be closed by means of a pair of planar elements or a shell or, as shown in the attached figures, three open side walls which can be closed by means of the box-like shell 100.

In particular, in the latter case, considering the attached figures, the working chamber 11 may have only one side wall 116 which may be any and not necessarily the one represented in the figures. For example, it may be the wall at the pivot 20, i.e.—considering the attached figures—the upper wall, or the opposite one, i.e.—considering the attached figures—the lower wall.

Thanks to such characteristic, when the shell 100 is not present, the operative chamber 11 may have one or more openings 118, while—upon coupling the hinge body 10 with the box-like shell 100—such opening 118 may be closed so that the operative chamber 11 is substantially closed as described above and has four side walls 116.

Essentially, the slider element 30 may comprise an operative head 33 which may include the operative face 32, a shaft 41 and means 40' for the fixing thereof once inserted into the seat 19 of the operative chamber 11.

In particular, the hinge body 10 may therefore comprise the opening 118 to allow the insertion of the operative head 33 into the seat 19 and a through opening 121 to allow the insertion of the shaft 41 into the seat 19.

Preferably, the shaft 41 may be inserted coaxially to the axis Y, while the operative head 33 may be inserted through the opening 118 perpendicularly to the axis Y.

Upon inserting the shaft 41 and the operative head 33 into the seat 19, the latter may then be coupled by means of the fixing means 40'.

Suitably, the operative head 33 and the shaft 41 may be mutually coupled so as to slide integrally joined along the axis Y. In particular, the fixing means 40' may be configured in a manner such that the operative head 33 and the shaft 41 define a unitary assembly, i.e. a slider 30, integrally slidable along the axis Y.

Such coupling may be of different types depending on the requirements. For example, the shaft 41 may have an end 42 which may be inserted into a seat 33' of the operative head 33. The seat 33' may be a blind hole.

In particular, the operative head 33 and the end 42 may comprise a respective through hole 33", 42' while a pin or grub screw 40 may be provided passing through the through holes 33', 42' of the operative head 33 and of the shaft 41 to mutually couple the latter.

Possibly, the seat 33' and the end 42 may be threaded.

In any case, the mutual sliding of the shaft 41 with respect to the operative head 33 may be avoided.

The shaft 41 may be made of a first metallic material, for example aluminium, or polymeric material, while the operative head 33 may be made of a second metallic material harder than the first, for example steel. This will allow to provide only the part actually at contact with the cam element 21 made of "hard" and more expensive material, while the remaining part of the slider element 30 may be made of more economical material.

The slider element 30 may therefore slide between a stroke start operative position in which the operative head 33 is proximal to the bottom wall 112 of the working chamber 11, illustrated for example in FIGS. 7, 10A, 13A and 16A, and a stroke end operative position in which the operative head 33 is distal from the bottom wall 112, illustrated for example in FIGS. 6, 9A, 12A and 15A.

Suitably, such start and stroke end positions may vary, and not necessarily correspond to the maximum distal and/or proximal position that can be taken by the operative head 33.

Furthermore, as mentioned above, they may not necessarily correspond to the shutter closed and shutter open position. As a matter of fact, when the slider 30 is in the stroke start position, the shutter A may be open or closed, preferably open, while when the slider 30 is in the stroke end position the shutter A may be closed or open, preferably closed.

The operative head 33 may therefore slide in the operative chamber 11, while the shaft 41 may possibly protrude therefrom as better explained hereinafter.

According to a particular aspect of the invention, suitable means 333, 341 for guiding the sliding of the slider element 30 along the axis Y may be provided for. The guide means 333, 341 may be spaced apart along the axis Y. In other words, the slider 30 may be guided in at least two areas spaced apart along the axis Y so as to avoid a misalignment of the slider element 30.

Suitably, as better explained hereinafter, the guide means 333 may act on the operative head 33 while the guide means 341 may act on the shaft 41.

More in detail, the guide means 333 may comprise one or more surfaces substantially flat and parallel to the axis Y designed to come into contact with the head 33 to guide it along the sliding along the axis Y.

Preferably, but not exclusively, one or more parts of one or more of the side walls 116 of the operative chamber 11 may guide the sliding of the slider element 30, and in particular, said head 33.

In particular, the operative head 33 may have lateral dimensions, i.e. in a plane substantially perpendicular to the axis Y, substantially equal to those of the operative chamber 11 so that the side walls 116 thereof guide the sliding of the operative head 33 between the positions proximal and distal to/from the bottom wall 112.

When the shell 100 is present, one or more of the inner surfaces of the latter may define the walls 116 of the operative chamber 11 and therefore they may interact with the head 33 to guide the sliding thereof.

As shown for example in the figures, the means 333 may comprise the pairs of opposite operative surfaces 106, 107 and 105, 140, which may at least partially come into contact with the operative head 33 to guide it during the sliding thereof and therefore of the slider 30.

Suitably, the operative head 33 may have a substantially T-shaped cross-section with an area 37 including the operative face 32 facing the front wall 113 of the working chamber 11 and an area 38 including the rear face 34 facing the bottom wall 112 of the chamber 11.

in particular, the area 38 may be substantially parallelepiped-shaped and it may have a pair of side faces 35 and a pair of side faces 36 facing and preferably at contact with respective pairs of side walls 116 of the chamber 11. In this manner, the side walls 116 may act as a sliding guide for the area 38 of the operative head 33 and therefore for the slider element 30.

In other words, the operative head 33 may comprise the pair of upper and lower faces 35 and the pair of side faces 36 designed to come into contact with the pair of surfaces 105, 140 respectively and the pair of surfaces 106, 107 upon coupling the shell 100 with the hinge body 10.

It is clear that the faces 35 may be parallel to each other same case applying to the faces 36, while the faces 35 and the faces 36 may be perpendicular to each other.

Suitably, the faces 35, 36 and possibly also the pair of surfaces 105, 140 and the pair of surfaces 106, 107 may be substantially flat.

Thanks to the aforementioned configuration, the guide walls 116 may guide the sliding of the operative head 33 along the axis Y and they may also prevent the rotation of the operative head 33 with respect to the axis Y and therefore also the rotation of the shaft 41 with respect to the axis Y.

On the other hand, the area 37 may interact with the portion 13 of the hinge body 10. In particular, the area 37 may have a substantially plate-like shape and substantially perpendicular to the axis X, while the portion 13 may have a seat 132 for such area 37.

More in detail, the area 37 may slide in the seat 132 upon sliding the slider element 30. For example, the portion 13 may comprise a pair of facing walls 133 designed to interact, preferably to be at contact, with the outer faces 37' of the area 37.

It is clear that the walls 133 and the outer faces 37' may all be substantially perpendicular to the axis X.

Thanks to such characteristic, the facing walls 133 may guide the longitudinal sliding along the axis Y of the area 37 and therefore of the head 33 of the slider element 30.

It is clear that the operative head 33 may have different configurations and/or may be of several pieces.

For example, even if not shown in the attached figures, the operative head 33 may have a substantially planar front area 37 arranged perpendicularly to the axis X, or, according to a different embodiment, the operative head 33 may be substantially parallelepiped-shaped.

The hinge 1 may further comprise means 50, 60, 70, 80 for controlling the sliding of the slider element 30 along at least one section of the sliding thereof between the stroke start operative position and the stroke end operative position, and possibly means 90 for adjusting the action of the control means 50, 60, 70, 80.

It is clear that the hinge 1 may be without control means 50, 60, 70, 80 or, preferably, it may comprise one or more of the control means 50, 60, 70, 80.

Possibly, when present, the control means 50 can be arranged inside the operative chamber 11, while the control means 60, 70, 80 may preferably but not exclusively be arranged outside the operative chamber 11.

The control means 50, 60, 70, 80 may be of the mechanical or hydraulic type. In particular, the control means 50, 60, 70 may be mechanical while the control means 80 may be hydraulic.

Suitably, the insertion/removal of the hinge body 10 into/from the shell 100 may also correspond to the insertion/removal of the control means 50, 60, 70, 80. In other words, the hinge assembly may comprise the hinge body 10, the pivot 20, the slider 30 and one or more control means 50, 60, 70, 80.

Advantageously, should there arise the need to modify the type or extent of the control of the movement of the shutter A, it will be sufficient to extract the hinge assembly and modify or replace one or more of the control means 50, 60, 70, 80.

Possibly, a kit which may comprise the hinge body 10, the pivot 20, the slider 30, possibly even one or more of the control means 50, 60, 70, 80 may be provided for. Possibly, the kit may comprise the shell 100.

Suitably, the shell 100 may be suitable for housing different hinge bodies 10 and/or pivots 20 and/or sliders 30 and/or control means 50, 60, 70, 80 so as to allow the interchangeability of one or more parts of the hinge 1 without removing the shell from the frame.

The mechanical hinge may be without hydraulic damping means, while the hydraulic hinge may include mechanical control means, for example the control means 50.

For example, as shown in FIGS. 8 to 13B, the hinge 1 may be of the mechanical type and it may comprise mechanical damping means 60, 70 acting on the slider element 30 to mechanically damp the sliding thereof along the axis Y, while, as illustrated in FIGS. 14 to 16B, the hinge 1 may include hydraulic damping means 80 acting on the slider element 30 to hydraulically damp the sliding thereof along the axis Y.

Examples of different control means 50, 60, 70, 80 are described hereinafter.

Preferably, the control means 60, 70, 80, when present, may be alternative to each other, while the control means 50 may or may not be present irrespectively of the control means.

In particular, in the embodiments illustrated in FIGS. 4A to 16B, the hinge 1 may include elastic counteracting means 51 acting on the slider 30 arranged inside the operative chamber 11 which may therefore define the control means 50, while in the embodiments illustrated in FIGS. 17A to 19B, the hinge 1 may be without elastic counteracting means 51 arranged inside the operative chamber 11.

Depending on the configuration, the elastic counteracting means 51 may be thrust or recovery means.

In the case of thrust elastic counteracting means, the force thereof must be such to automatically return the shutter A from the open or closed position that it reaches when the slider 30 is in proximal position towards the other of the open or closed position that it reaches when the slider element 30 is in stroke end position.

In this case, depending on whether the position reached by the shutter A when slider element 30 is in stroke start position is open or closed, the hinge 1 may be an opening hinge or a closing hinge.

In the case of recovery elastic counteracting means instead, the force thereof may be such not to be able to push the shutter A from the open or closed position that it reaches when the slider element 30 is in stroke start position towards the other of the open or closed position that it reaches when the slider element 30 is in stroke end position. In this case, the shutter A must be moved manually or however using external actuator means with respect to the hinge 1, for example a motor.

However, the force of the recovery elastic means, must be such to return the slider element 30 from the stroke start position to the stroke end position.

In any case, the elastic counteracting means 51 may be configured to promote the sliding of the slider 30 from the stroke start position to the stroke end position and to counter the sliding thereof from the stroke end position to the stroke start position.

The elastic counteracting means 51 may be interposed between the operative head 33 and the bottom wall 120 of the operative chamber 11.

More in detail, the operative head 33 may comprise an abutment surface 34 facing the bottom wall 120. The area 38 of the operative head 33 may therefore comprise the side faces 35, 36 and the abutment surface 34 substantially perpendicular to the latter.

On the other hand, the elastic counteracting means 51 may comprise, respectively, consist of a spiral spring 52 fitted on the shaft 41 and interposed between the bottom wall 120 and the abutment surface 34 so as to promote the passage from the proximal position to the distal position of the operative head 33 and counter the passage thereof from the distal position to the proximal position.

In this manner, the shaft 41 may act as a guide for the spring 52. It is clear that the spring 52 may have an internal diameter substantially equal to or slightly greater than the diameter of the shaft 41 on which it is fitted.

According to a particular aspect of the invention, besides the spring 52, the elastic counteracting means 51 may comprise one or more springs interposed between the bottom wall 120 and the abutment surface 34.

In particular, the springs 52 may be arranged adjacent so as to define respective axes coincident or parallel to the axis Y. For example, the spring 52 and a pair of springs arranged above and below the spring 52 may be provided for. The springs 52 may all be identical to each other.

Possibly, the side walls 116 of the operative chamber 11 may guide the springs 52 during the sliding of the slider element 30 so that they remain in position in the operative chamber 11.

According to a particular aspect of the invention, the portion 12 may comprise a seat for the shaft 41 so that the latter can slide therein.

Preferably, such seat may be the longitudinal seat 121 coaxial with the axis Y, and it may be, for example, a hole passing through the portion 12.

Suitably, the through hole 121 may have substantially the same diameter or slightly greater than the diameter of the shaft 41. In this manner, the through hole 121 may guide the sliding of the shaft 41 and therefore of the slider 30 along the axis Y, thus defining the guide means 341.

In other words, the guide means 333 may comprise the side walls 116 of the operative chamber 11 suitable to interact with the operative head 33 to guide it, and the guide means 341 may comprise the through hole 121 suitable to interact with the shaft 41 to guide it along the axis Y.

Thus, the slider element 30 may be guided at two portions spaced apart from each other along the axis Y, i.e. at the head 33 and at the shaft 41, preferably at the end 43 of the shaft 41 so as to advantageously maintain the alignment of the slider element 30 along the axis Y.

Operatively, the head 33 may thus be inserted through the opening 118 while the shaft 41 may be inserted through the through hole 121. Suitably, the head 33 and the shaft 41 may be mutually coupled by means of the pin 40 as described above. Should the spring 52 be present, the latter may be inserted through the opening 118 similarly to the operative head 33.

In particular, the operative head 33 and the spring 52 may first be inserted between the head 33 and the bottom surface 120, and then the shaft 41 may be inserted so that it passes through the spring 52 and so that the end 42 is inserted in the seat 33' of the operative head 33.

In other words, the springs 52 may also remain in the seat 19.

The hinge 1 may have very limited vertical, horizontal and, in particular, longitudinal overall dimensions.

The spring 51 may have an outer diameter equal to or slightly smaller than the height H of the hinge body 10. On the other hand, the operative head 33 may have a width substantially equal to the height H of the hinge body 10.

Suitably, such height H may be substantially equal to or slightly greater than that of the slider 31. By way of example, such height H may be less than 30 mm, and preferably less than 25 mm and even more preferably less than 20 mm.

Furthermore, according to a particular embodiment, the slider element 30 may have a length such that when the latter is in the stroke start position the shaft 41 is substantially flushed with the hinge body 10. In particular, the shaft 41 may have an end 43 opposite to the end 42, while the portion 12 of the hinge body 10 may have an outer wall 122 opposite to the surface 120.

Figure 10A:
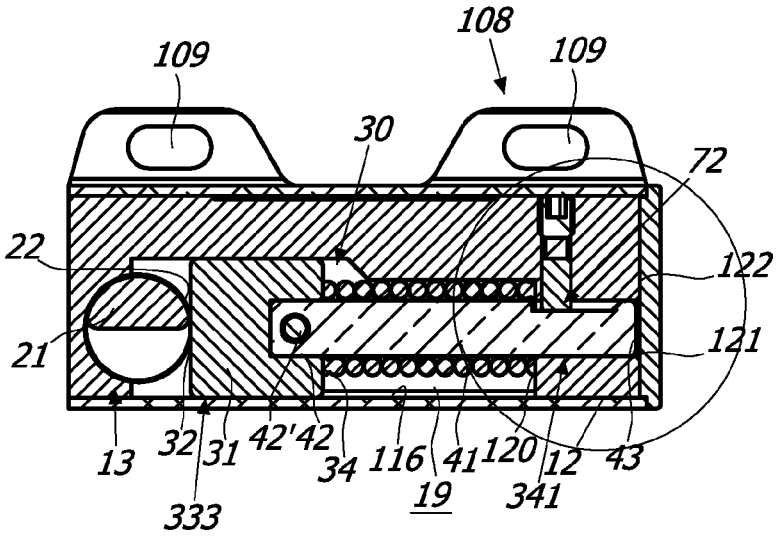
Figure 10B:
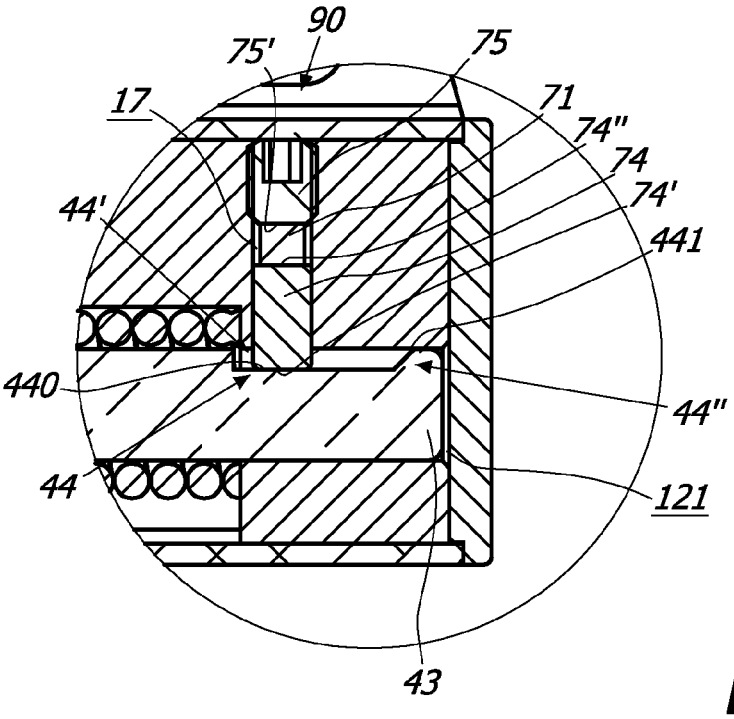

Suitably, when the slider element 30 is in the stroke start position, the end 43 may be substantially flushed with the outer wall 122 (FIG. 10A).

Furthermore, the through hole 121 may have a length substantially equal to or greater than the stroke of the slider element 30. In this manner, the hinge 10 may have the operative chamber 11 of maximum length and the portion 12 of minimum length, while keeping the shaft 41 guided at the end 43 thereof.

Thanks to such characteristic, the overall dimensions may be particularly reduced, and in particular the length LU of the hinge body 10 which may be less than 110 mm, preferably less than 80 mm.

Figure 4A:
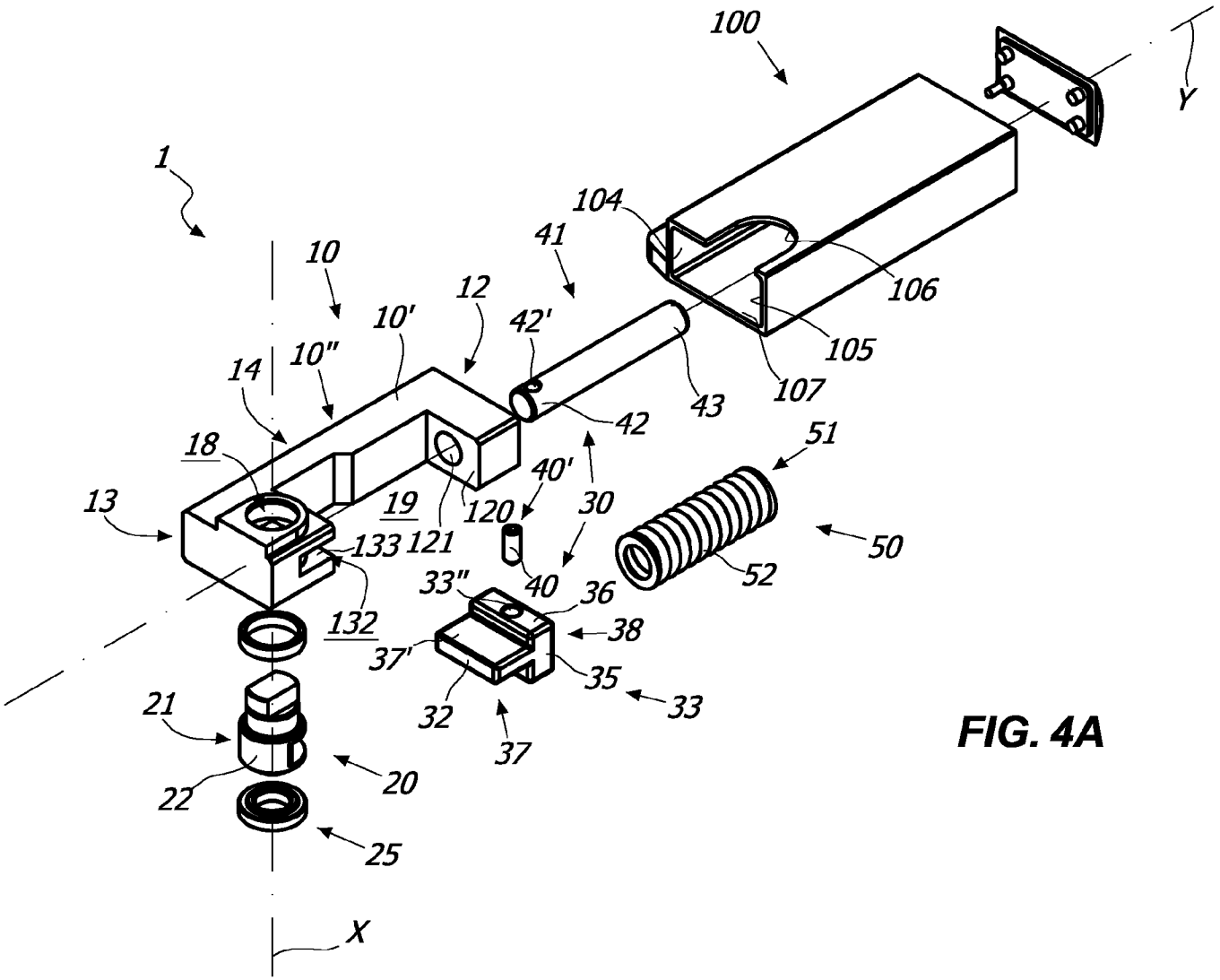
FIGS. 4A and 4B are exploded views of a left and right embodiment of the hinge 1 comprising the elastic means 51.
Figure 4B:
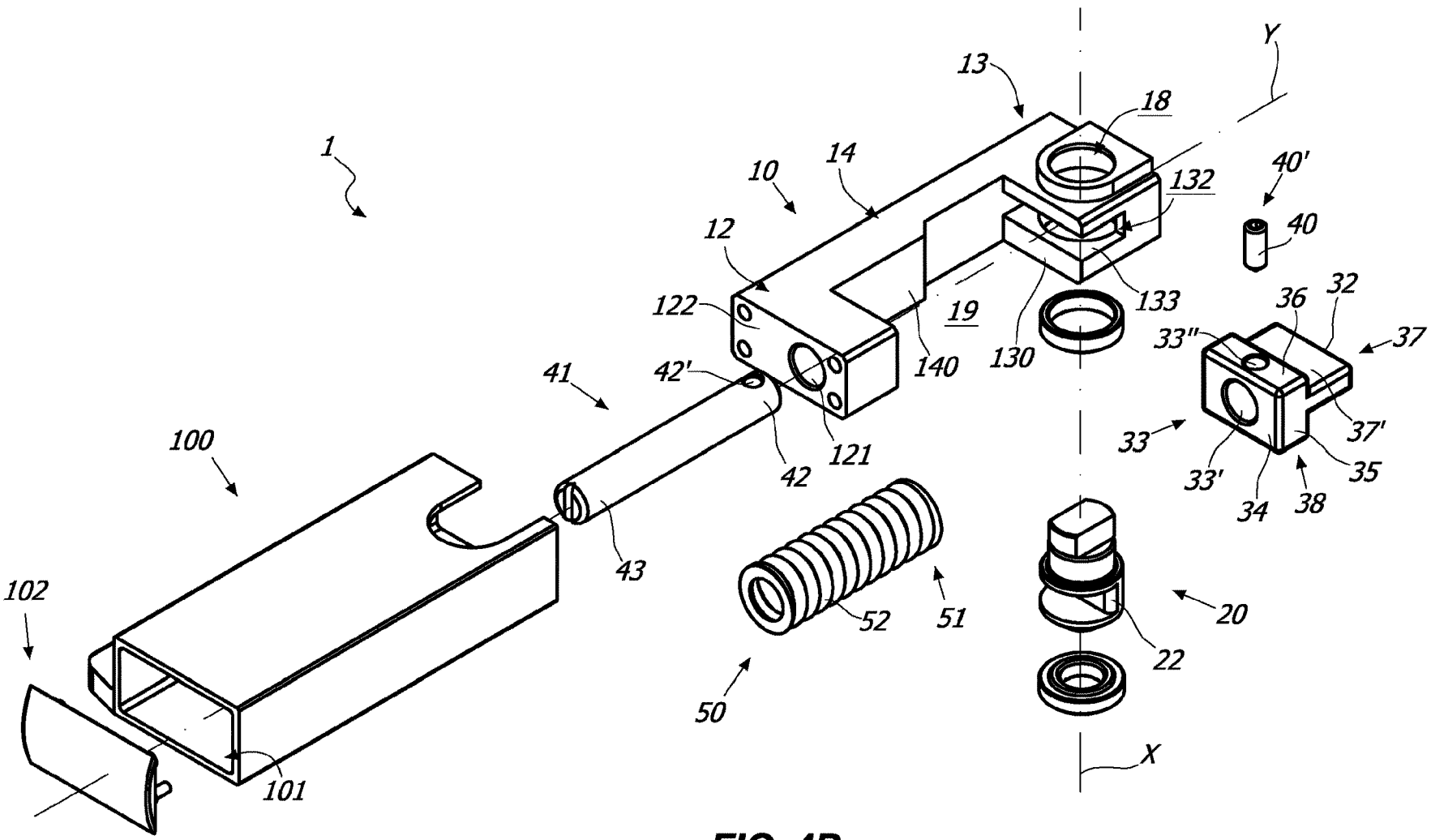
Figure 5:
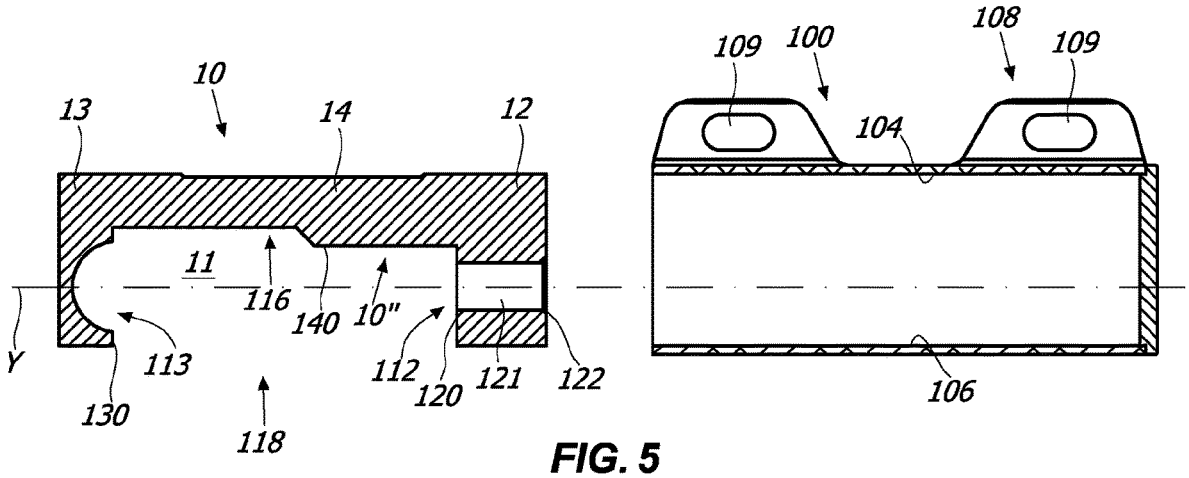
FIG. 5 is a schematic cross-sectional view of some components of the hinge 1.
Figure 6:
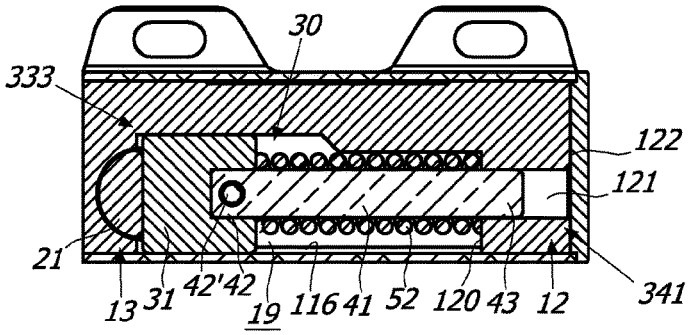
FIGS. 6 and 7 are axial cross-sectional views of the embodiment of the hinge 1 of FIG. 4A respectively in the shutter A closed and open at 90° position.
Figure 7:
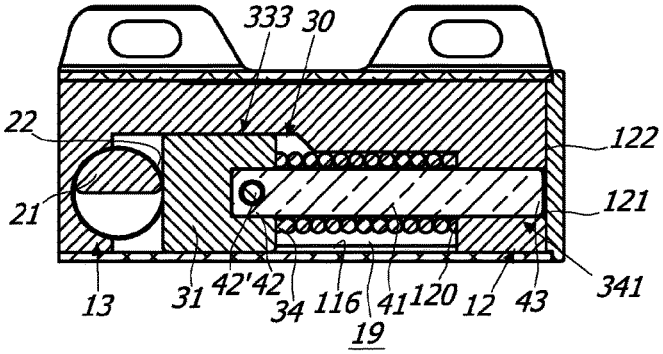

As described above, the hinge 1 may have only the control means 50, as illustrated in FIGS. 4A and 4B, or it may comprise one of the damping means 70 (FIG. 17A), 60 (FIG. 18A) and 80 (FIG. 19A), or it may comprise the control means 50 and one of the damping means 70 (FIG. 8), 60 (FIG. 11) and 80 (FIG. 13).

Figure 8:
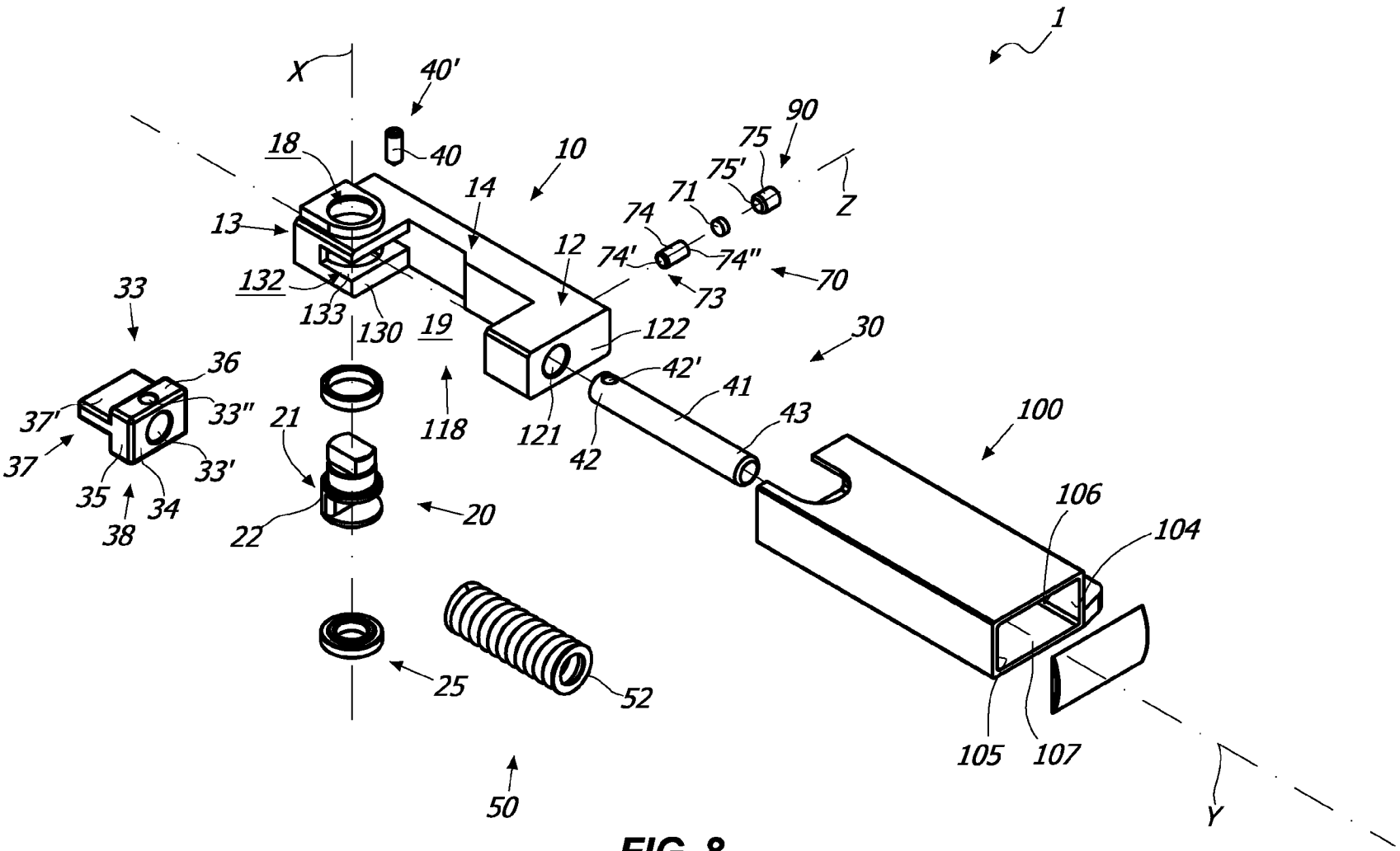
FIG. 8 is an exploded view of a different embodiment of the hinge 1 comprising the damping means 70.
Figure 9A:
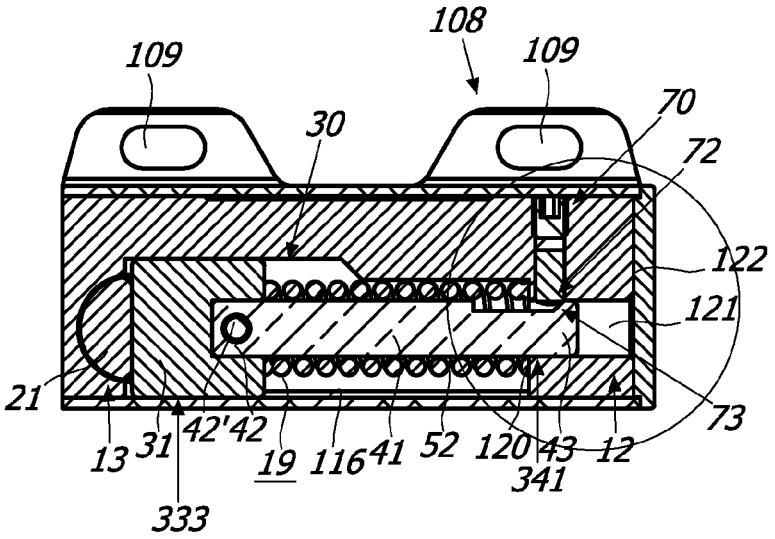
FIGS. 9A and 10A are axial cross-sectional views of the embodiment of the hinge 1 of FIG. 8 respectively in shutter A closed and open at 90° position, with FIGS. 9B and 10B showing an enlargement of some details of FIGS. 9A to 10A.
Figure 9B:
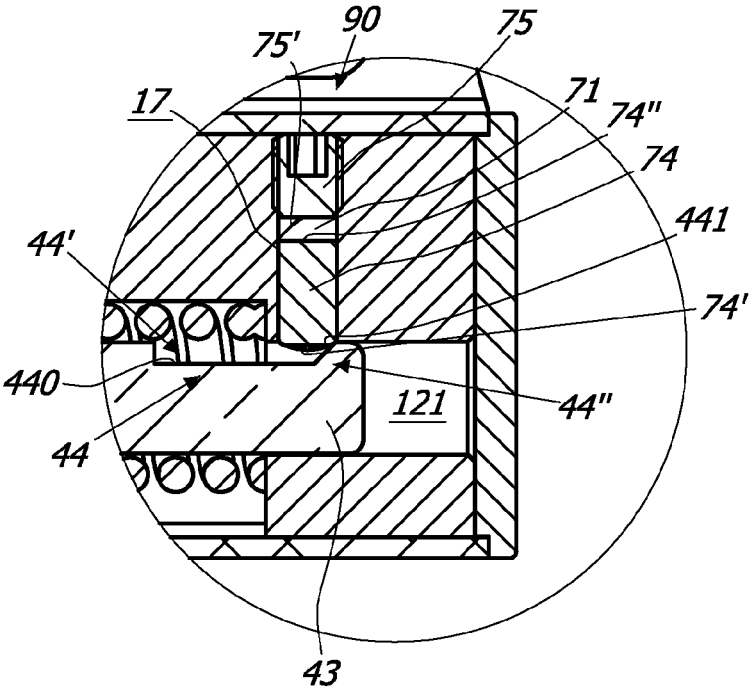
Figure 17A:
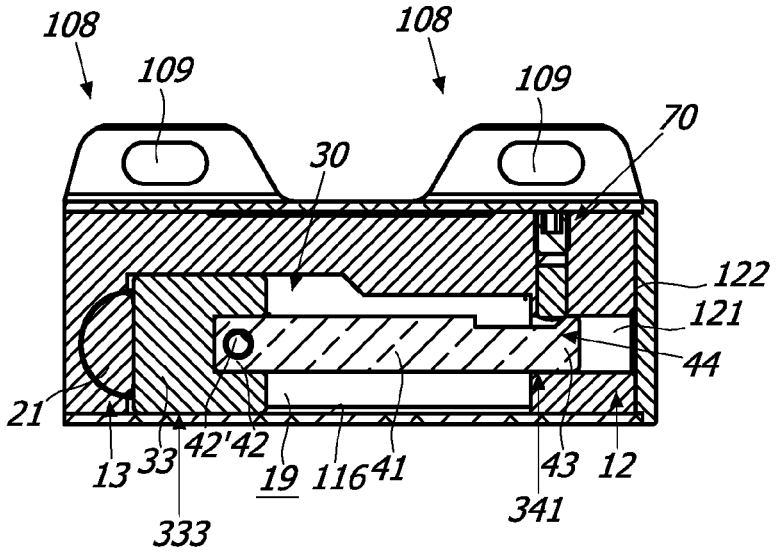
FIGS. 17A, 18A, 19A and 17B, 18B, 19B are different embodiments of the hinge 1 without the elastic counteracting elements 51, respectively in the shutter A closed and open at 90° position.
Figure 17B:
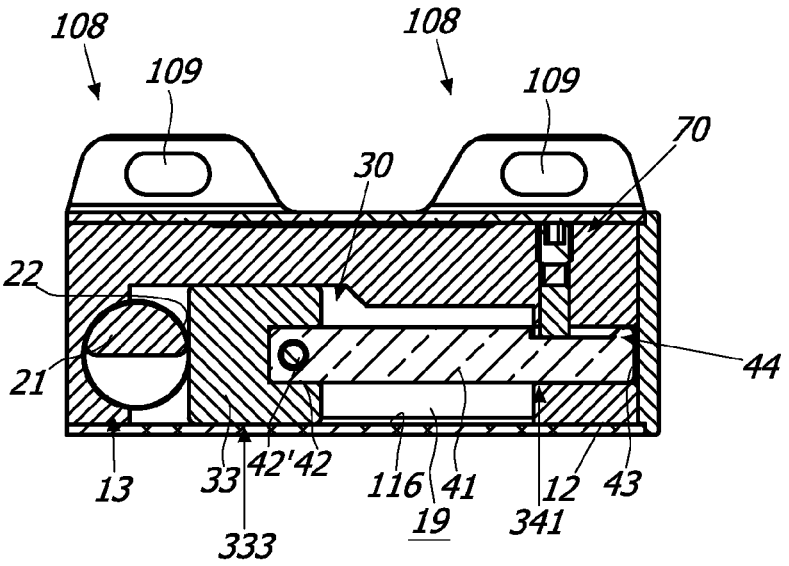

According to a particular embodiment of the hinge 1 illustrated in FIG. 8 or in FIGS. 17A and 17B cam elements 71 and cam follower 72 for damping the sliding of the slider element 30 from the stroke end position to the stroke start position may be provided for, thus defining the mechanical control means 70 which may therefore be mechanical damping means 70.

In particular, the slider element 30 may comprise the cam elements 72, while the hinge body 10 may comprise the cam follower elements 73 which may be configured to slide along an axis Z substantially transverse to the axis Y and preferably perpendicular thereto. Possibly, similarly, as shown in the attached figures, a system of inclined planes 72, 73 for promoting the sliding of the plane 73 along the axis Z may be provided for.

Suitably, elastic counteracting means 71 acting on the element 73 to counter the sliding thereof may be provided for.

More in detail, the shaft 41 may comprise a longitudinal groove 44 which may have a portion 44' with a surface 440 substantially coaxial with the axis Y and a portion 44" with a surface 441 substantially inclined with respect to the axis Y, i.e. diverging therefrom defining the cam element 72.

On the other hand, a slidable element 74 along the axis Z, for example a cylinder, having an end 74' designed to interact with the portion 44" of the groove 44 to define the elements 73 may be provided for.

In this manner, the sliding along the axis Y of the portion 44" may correspond to the sliding along the axis Z of the cylinder 74.

Suitably, means for guiding the sliding of the cylinder 74 along such axis Z may be provided for. For example, the hinge body 10 may comprise a circular seat 17 suitable to house the cylinder 74.

Preferably, such seat 17 may be arranged at the portion 12 of the hinge body 10.

On the other hand, the longitudinal groove 44 and the cylinder 74 may be mutually configured in a manner such that for a section of the sliding of the slider element 30 the end 74' may interact with the surface 440 and for a section of the sliding of the slider element 30 the end 74' may interact with the surface 441.

Preferably, when the slider element 30 is in the stroke start position, the end 74' may be at contact with the surface 440 and when the slider element 30 is in the stroke end position the end 74' may be at contact with the surface 441.

The elastic counteracting elements 71 may be a spring or, preferably, an elastomeric element, for example an elastomeric cylinder. When the cylinder 74 slides, the opposite end 74" at the end 74' of the cylinder 74 may promote the compression of the elastomeric cylinder 71 and thus counter the sliding of the cylinder 74.

In other words, when the end 74' is at contact with the surface 440, the slider element 30 may slide freely, while when the end 74' is at contact with the surface 441, the elastomeric cylinder 71 may counter the sliding of the cylinder 74 and therefore damp the sliding of the slider element 30.

Suitably, the circular seat 17 may be a through hole having an opening facing toward the slider element 30 and an opening facing outwards. In particular, a closing element 75 designed to close the through opening and having a surface 75' designed to act as an abutment for the elastomeric cylinder 71 may thus be provided for.

In other words, the elastomeric cylinder 71 may remain interposed between the surface 75' of the closing element 75 and the groove 44 of the shaft 41 so that the sliding of the cylinder 74 corresponds to the compression of the elastomeric cylinder 71.

According to a particular aspect of the invention, the closing element 75 may be a grub screw which can be screwed into the seat 17 so as to vary the distance between the shaft 41 and the surface 75'. In this manner, screwing/unscrewing the grub screw 75 allows to vary the compression of the elastomeric cylinder 71 when the slider element 30 is in the start or stroke end position.

In other words, the grub screw 75 may allow to adjust the sliding of the cylinder 74 and therefore the damping of the sliding of the slider element 30 acting as means 90 for adjusting the sliding of the latter.

Preferably, but not exclusively, the elastomeric cylinder 71 may be always at contact with the surface 75' and with the surfaces 440 and 441 of the shaft 41. On the other hand, the elastomeric cylinder 71 may have small dimensions so that the cylinder 74 is free to slide for a section and be countered for another.

Furthermore, it is clear that upon varying the configuration of the portions 44' and 44" and/or the inclination of the surface 441, varying the configuration of the elastomeric cylinder 71 and/or the distance between the shaft 41 and the surface 75' may allow to obtain a different damping action and/or a damping action only for some sections of the stroke of the slider element 30.

Although the present text has described a portion 44' inclined in a manner such to promote the compression of the elastomeric cylinder 71 when the slider element 30 passes from the stroke end position to the stroke start position, the portion 44' may be similarly inclined in the opposite direction to promote the compression of the elastomeric cylinder 71 when the slider element 30 passes from the stroke start position to the stroke end position.

Suitably, the shells 100 may therefore have dimensions substantially equal to or slightly greater than the hinge body 10. In particular, the shells 100 may have a length substantially equal to the length LU of the hinge body 10. The inner surfaces of the shells 101 may therefore be at contact with the outer surface 10' of the hinge body 10.

In this case, the through hole 121 may have a length substantially equal to the stroke of the slider element 30 so that when the latter is in the stroke start position, the end 43 may be substantially flushed with the outer wall 122.

In this manner, the hinge 1 may have particularly small overall dimensions.

Figure 11:
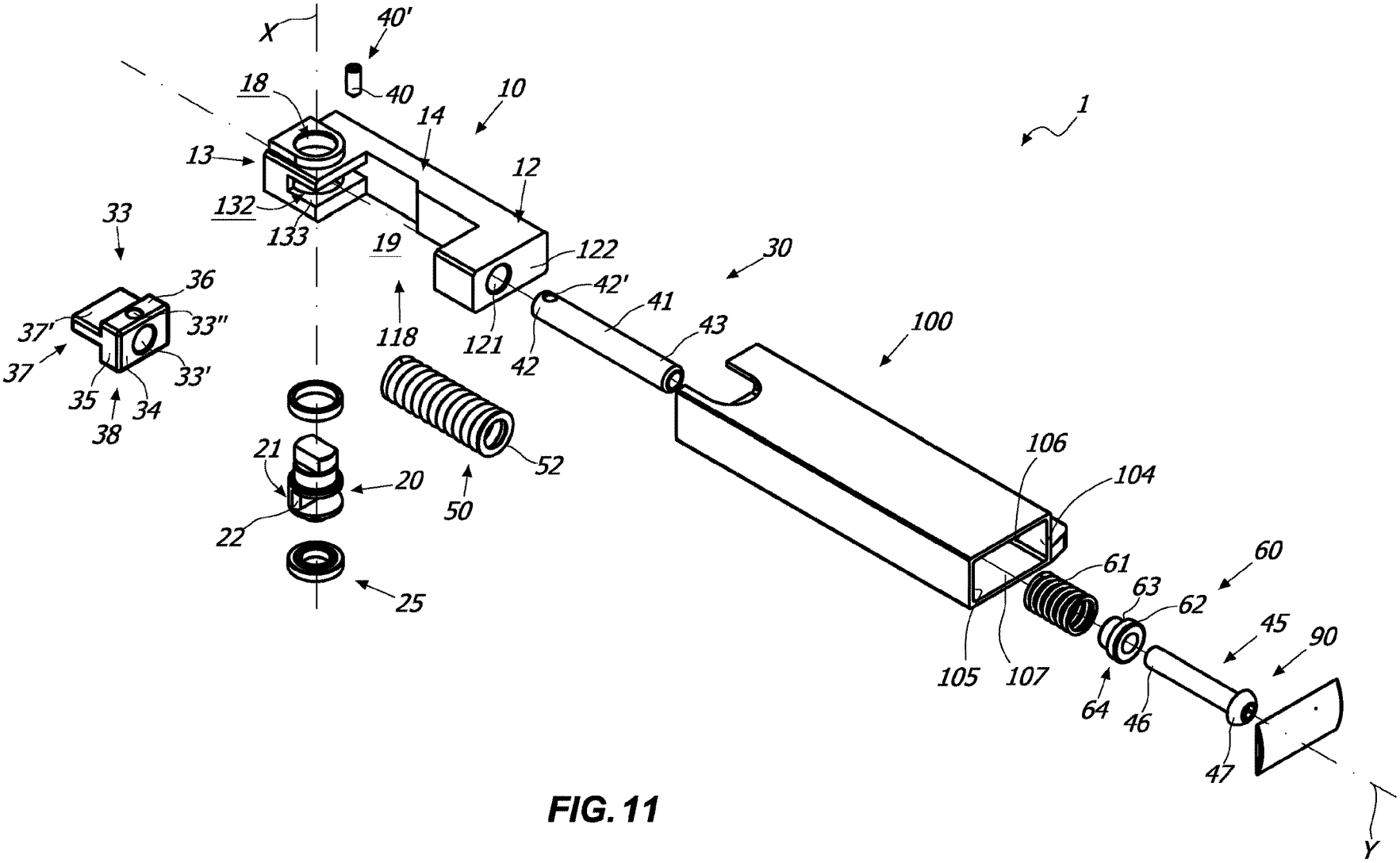
FIG. 11 is an exploded view of a different embodiment of the hinge 1 comprising the damping means 60.
Figure 12A:
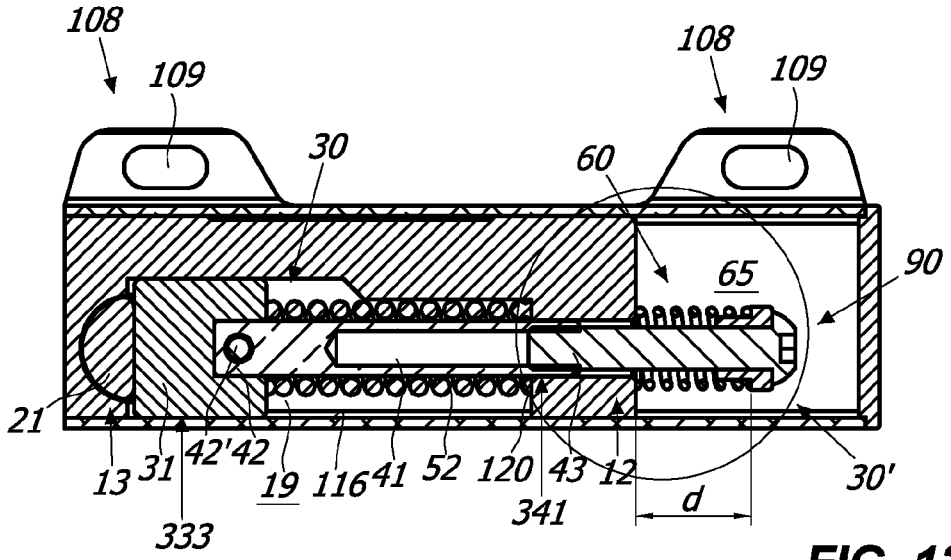
FIGS. 12A and 13A are axial cross-sectional views of the embodiment of the hinge 1 of FIG. 11 respectively in shutter A closed and open at 90° position, with FIGS. 12B and 13B showing an enlargement of some details of FIGS. 12A to 13A.
Figure 12B:
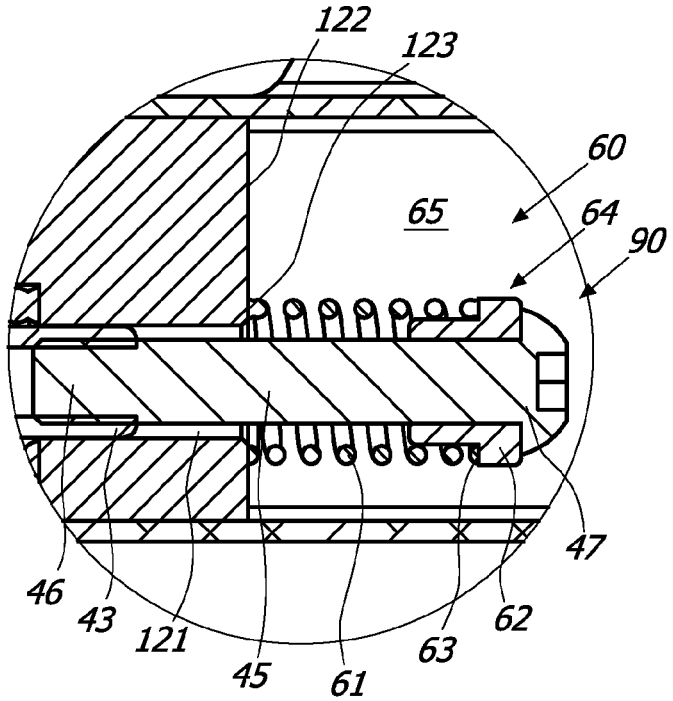
Figure 13A:
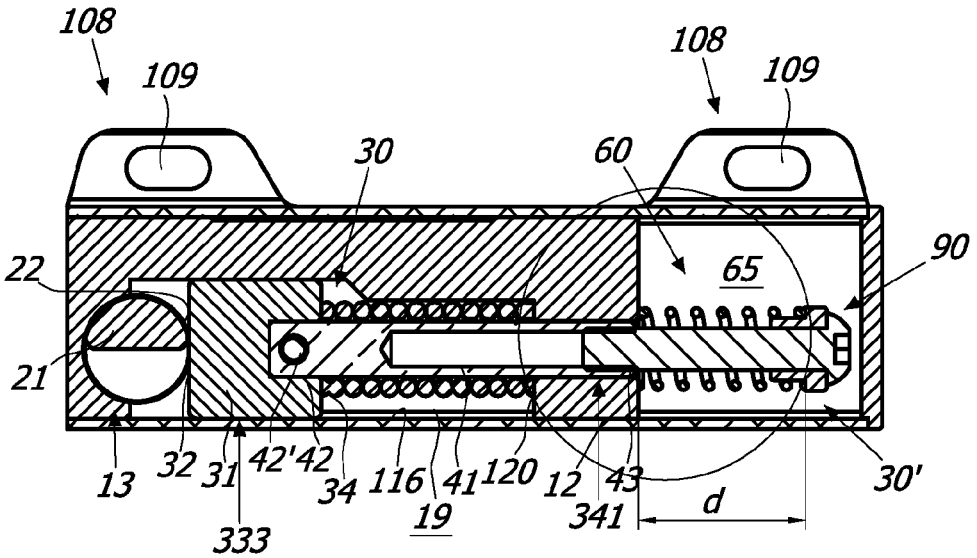
Figure 13B:
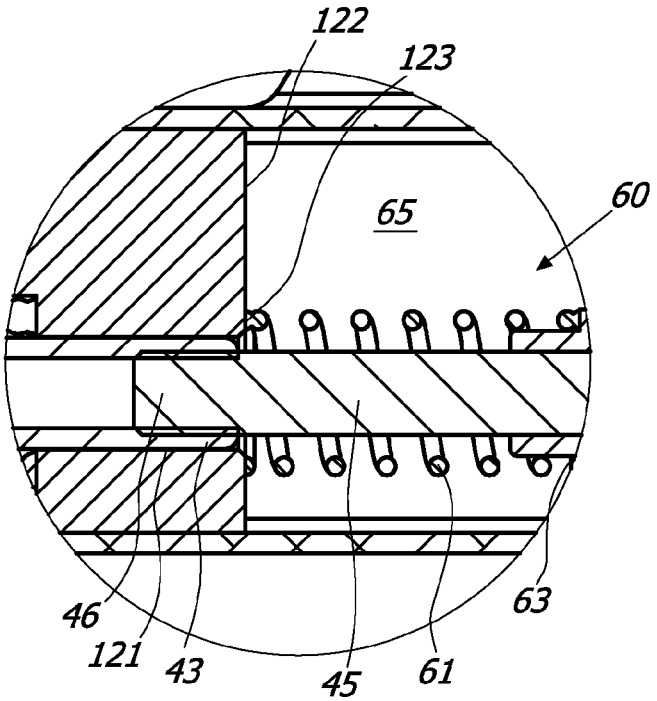
Figure 18A:
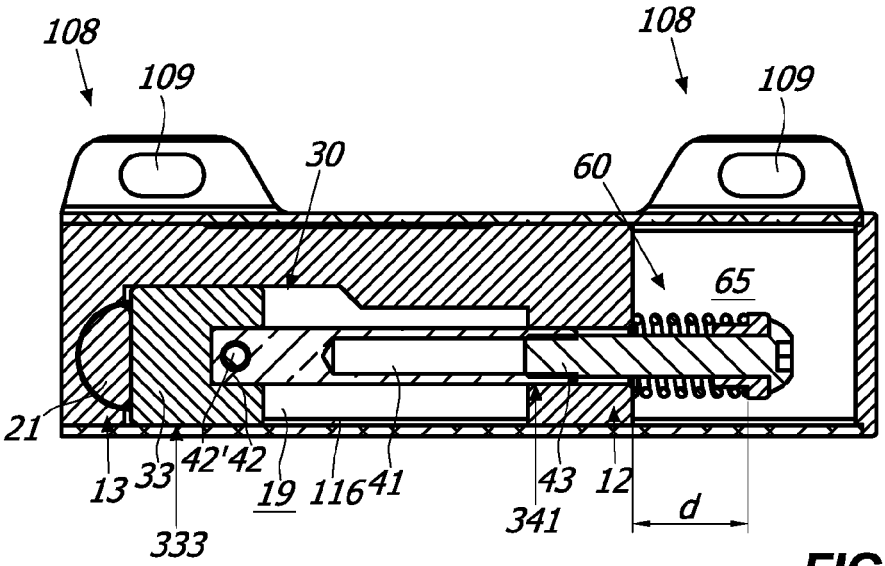
Figure 18B:
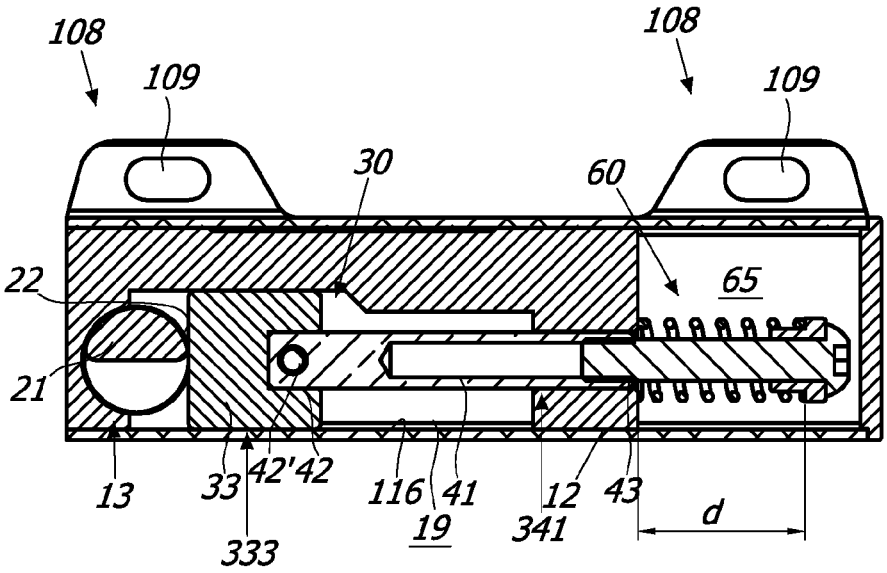

According to a different embodiment illustrated in FIG. 11 or in FIGS. 18A and 18B, the slider element 30 may have at least one portion 30' which may remain outside the operative chamber 11 during the sliding of the slider element 30.

In particular, the shaft 41 may be considerably longer than the operative chamber 11 so that a portion thereof defines the outer portion 30'. Suitably, a shaft 45 operatively coupled with the shaft 41 to slide therewith along the axis Y may be provided for. In this case, the shaft 45 may define the outer portion 30' of the slider element 30. Preferably, the shaft 45 may be defined by a screw.

Possibly, the shaft 41 may have a length such that when the slider element 30 is in the stroke start position, the end 43 may in any case be substantially flushed with the outer wall 122, while the shaft or screw 45 may define the outer portion 30'.

In any case, the outer portion 30' may comprise an annular projection 62 and elastic counteracting means 61 interposed between the outer wall 122 of the portion 12 of the hinge body 10 and the annular projection 62 may be provided for. For example, such elastic counteracting means may be a spring 61. Preferably, the spring 61 may be fitted on the portion 30'.

In this manner, the passage of the slider element 30 from the stroke start position to the stroke end position may correspond to the compression of the spring 61, while the passage from the stroke end position to the stroke start position may correspond to the expansion of the spring 61 thus defining the mechanical control means 60.

If the elastic means 51 are also present, the springs 52 and 61 can therefore be opposite so that the compression of one corresponds to the expansion of the other and vice versa.

It is therefore clear that the mechanical control means 50, 60 may be of thrust, recovery or damping type depending on the mutual configuration of the counteracting elements 51, 61.

Preferably, the mechanical means 60 may be damping means, i.e. configured to counter the slider element 30 upon sliding from the stroke end position to the stroke start position.

The shaft 45 may have an end 46 which can be screwed internally to the end 43 of the shaft 41, while the annular projection 62 may be arranged at the end 47 of the shaft 45 opposite to the end 46.

It is clear that when the shaft 45 is a screw, the end 47 may be the head of the screw.

The spring 61 may then be fitted on the shaft 45 to remain interposed between and abutting against an abutment surface 63 of the annular projection 62 and an abutment surface 123 of the wall 122.

It is clear that the head 47 of the shaft 45 may an define the annular projection 62 or, as shown in the attached figures, a shaped annular element 64 comprising the abutment surface 63 may be provided for.

According to a particular aspect of the invention, means for varying the distance d between the abutment surface 63 and 123 when the slider element 30 is in the stroke start or end position may also be provided for.

In other words, the mutual approach/moving away of the annular projection 62 and of the wall 122 may vary the pre-load of the spring 61 and therefore the amount of the damping.

For example, the screwing/unscrewing of the shaft 45 in the shaft 41 may decrease/increase the distance d and thus increase/decrease the pre-load of the spring 61 so as to define the means 90 for adjusting the damping of the slider element 30.

Possibly, the damping means 60 may act on the slider element 30 during the entire stroke thereof, preferably progressively, or only along a section, for example when the slider element 30 is in proximity of the stroke start position.

For example, the distance d when the slider element 30 is in the stroke start position may be substantially greater than the length of the spring 61. In this manner, for a section of the sliding from the stroke start position to the stroke end position, the slider element 30 can slide freely, while it may be opposed in proximity of the stroke end position.

Possibly, such configurations may be obtained or avoided by varying the spring 61 or simply by unscrewing/screwing the shaft 45.

Suitably, the end 47 of the shaft 45 may be maneuverable by an operator so that the latter can vary depending on the distance d.

The shell 100 may be slightly longer than the hinge body 10 so as to define an operative chamber 65 designed to reduce the outer portion 30' of the slider element 30.

Even in this case, the assembly of the hinge 1 may be particularly simple and fast. As a matter of fact, upon mounting shaft 41, the spring 61 may be fitted on the shaft 45 and the latter may be screwed onto the shaft 41.

Figure 14:
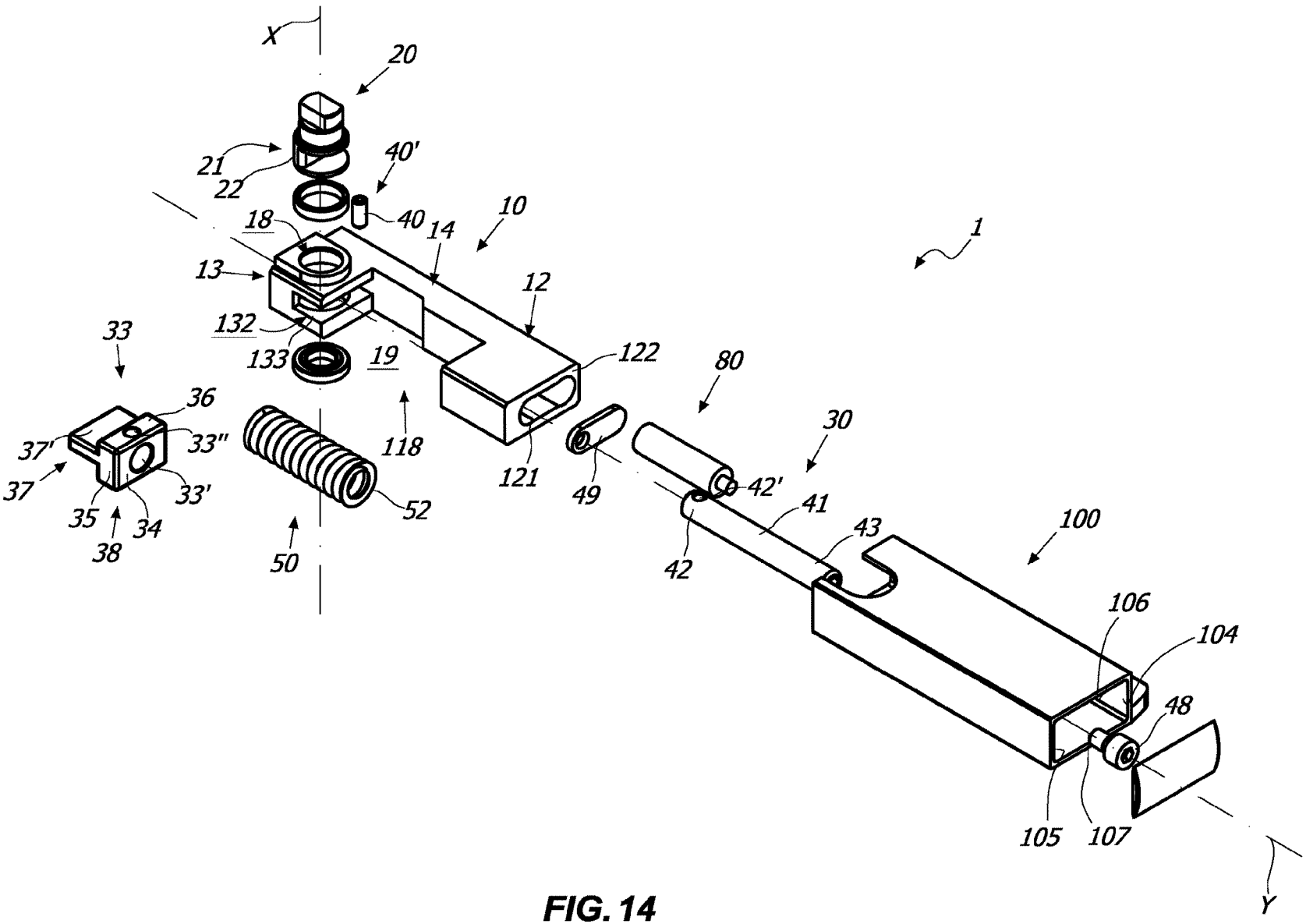
FIG. 14 is an exploded view of a different embodiment of the hinge 1 comprising the damping means 80.
Figure 15A:
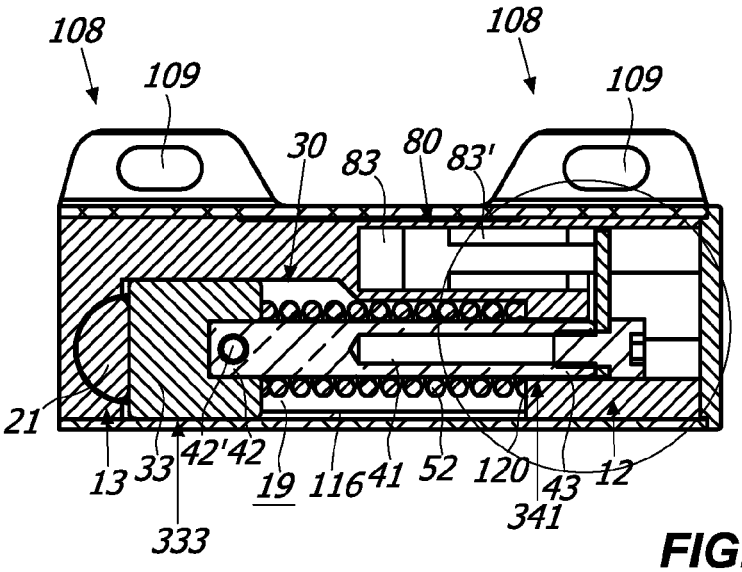
FIGS. 15A and 16A are axial cross-sectional views of the embodiment of the hinge 1 of FIG. 11 respectively in shutter A closed and open at 90° position, with FIGS. 15B and 16B showing an enlargement of some details of FIGS. 15A to 16A.
Figure 15B:
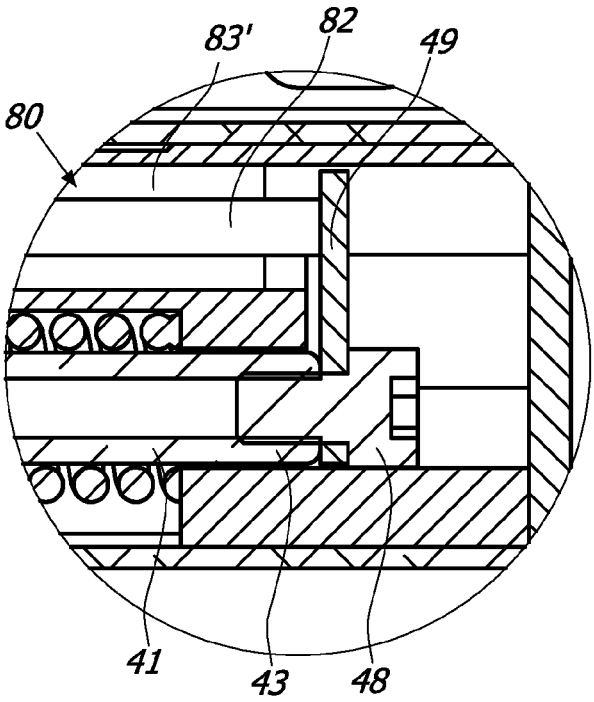
Figure 16A:
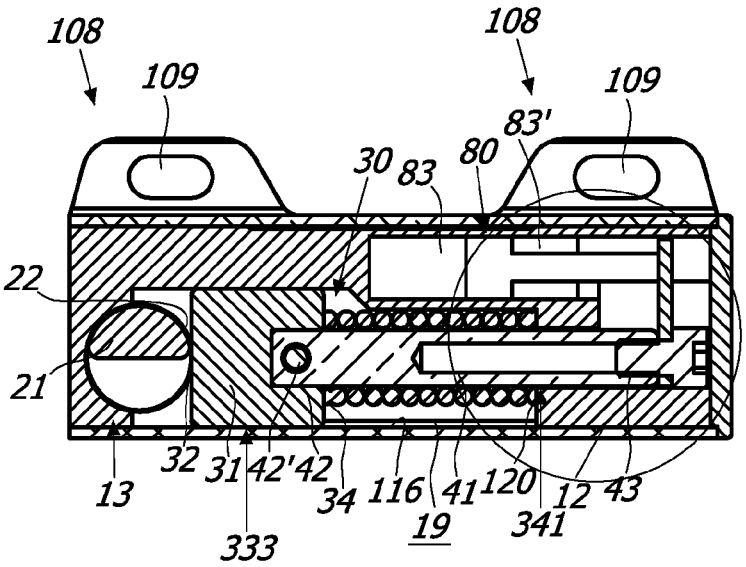
Figure 16B:
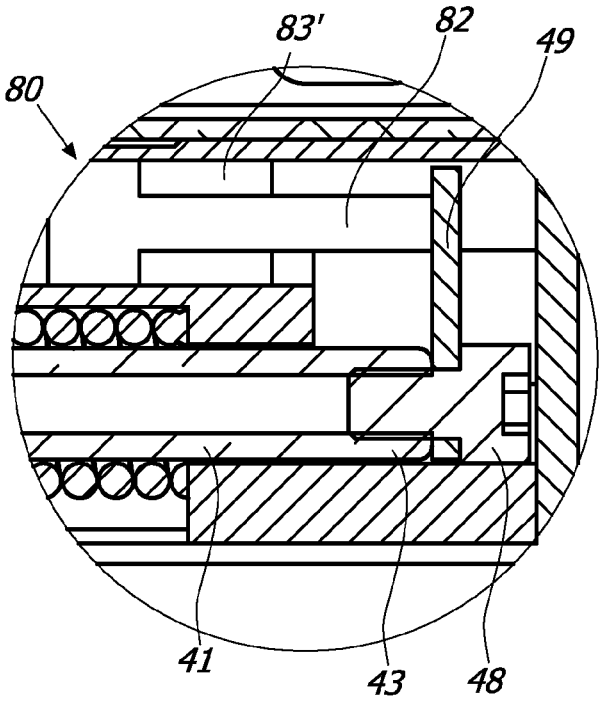
Figure 19A:
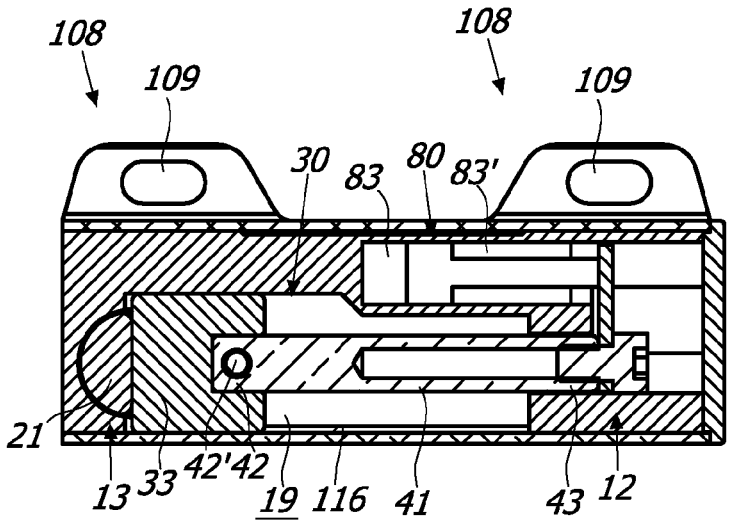
Figure 19B:
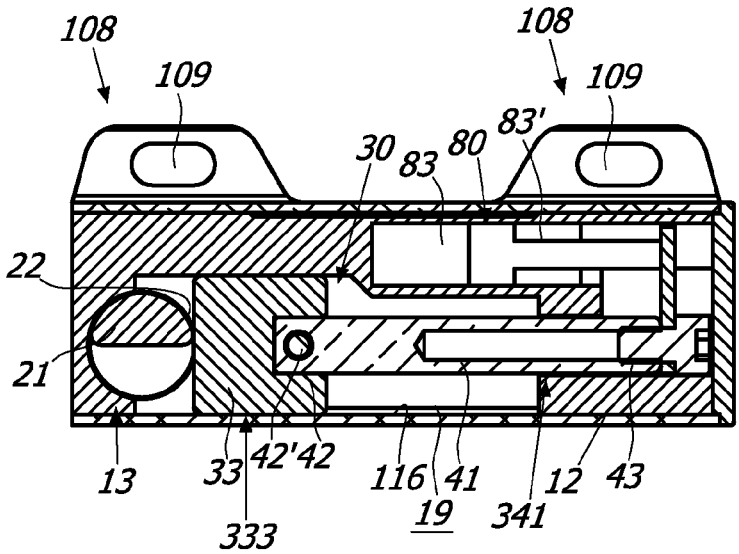

According to a further embodiment illustrated in FIG. 14 or in FIGS. 19A and 19B, means 80 for hydraulically damping the sliding of the slider element 30 may be present.

Such hydraulic damping means 80 may be of any type and may comprise a movable part 82 and a fixed part 81. For example, the hydraulic means 80 may comprise an operative chamber 81 containing a working fluid, for example oil, and a plunger element 82 sealingly inserted into the operative chamber 81 to divide the latter into a first and a second variable volume compartment 83, 83'.

Suitably, the plunger 82 and the operative chamber 81 may be mutually configured so that one slides with respect to the other. For example, the plunger 82 may slide between a position in which the compartment 83 has a minimum volume and the compartment 83' has a maximum volume and a position in which the compartment 83 has a maximum volume and the compartment 83' has a volume minimum.

In order to allow the passage of the working fluid between the compartments 83, 83', at least one hydraulic circuit to place the compartments 83, 83' in fluid communication may be provided for. Such circuit may be of the per se known type and it may be provided inside the plunger 82 and/or inside the hinge body 10.

Preferably, the hinge body 10 may comprise the operative chamber 81 arranged substantially parallel to the axis Y and spaced apart from the latter. In other words, the plunger 82 may therefore slide parallel to the slider element 30.

Thanks to such characteristic, the overall dimensions of the hinge 1 may be particularly small.

In any case, the plunger 82 may be operatively connected to the slider element 30 so that the movement of the latter corresponds to the movement of the former and vice versa.

The hydraulic circuit may also comprise flow control means such as valve means, calibrated passages or the like of the per se known type.

Thus, it is clear that—depending on the configuration of the hydraulic circuit, the compartments 83, 83' and generally the hydraulic means 80—the latter may control and/or damp the sliding of the plunger 82 and therefore of the slider element 30 for at least one section of the stroke thereof.

In particular, depending on the configuration, the hydraulic means 80 can counter the slider element 30 when the slider element 30 passes from the stroke end position to the stroke start position and/or when the slider element 30 passes from the stroke start position to the stroke end position and/or only during some sections of the stroke of the slider element 30.

Furthermore, in an equally known manner, grub screws or pins for adjusting the flow of the working liquid passing through the hydraulic circuit, thus defining the adjustment means 90, may be provided for.

According to a particular aspect of the invention, a screw element 48 may arranged outside the operative chamber 11 and which can be screwed onto the end 43 of the shaft 41 which—in the stroke start position of the slider element 30 may be outside the operative chamber 11 may be provided for so as to define the outer portion 30' of the slider element 30.

Suitably, a connecting plate 49 for operatively connecting the plunger 82 and the slider element 30 may be provided for. The latter may therefore also be outside the operating chamber 11.

More in detail, the connecting plate 49 may therefore be connected with the shaft 41 to slide therewith, and therefore with the slider element 30 and it may be connected with the movable part of the hydraulic means 80, for example the plunger 82.

In the present text, the elastic counteracting elements 51 have been described as recovery elements, while the mechanical means 60, 70 and hydraulic means 80 may act in an opposite manner, for example by exerting a damping action, i.e. countering the sliding of the slider element 30.

On the other hand, it is clear that should the counteracting elements 51 not be present, the mechanical means 60 may act as recovery or counteracting elements depending on the configuration thereof. For example, should the mechanical means 60 alone be present, depending on the configuration of the spring 62 and the distance d, the mechanical means 60 may have a function substantially similar to the means 50 thus acting as a thrust or a recovery means, or they may have a damping function.

In light of the above, it is clear that the hinge according to the invention attains the pre-set objectives.

The hinge according to the invention is susceptible to numerous modifications and variants all falling within the inventive concept outlined in the attached claims. All details can be replaced by other technically equivalent elements, and the materials can be different depending on the technical needs, without departing from the scope of protection of the invention.

Even though the hinge has been described with reference to the attached figures, the reference numbers utilised in the description and in the claims are meant for improving the intelligibility of the invention and thus do not limit the claimed scope of protection in any manner whatsoever.

The invention claimed is:

1. A low-bulkiness hinge for closing a closing element anchored to a stationary support structure, the hinge being movable between an opening and a closing position, the hinge comprising:

a hinge body anchorable to one of the closing element or the stationary support structure, the hinge body (10) internally comprising a longitudinal operative chamber defining a first axis (Y), the operative chamber comprising a bottom wall;

a pivot anchorable to another one of the closing element or the stationary support structure and defining a second axis substantially perpendicular to the first axis, the pivot and the hinge body being coupled to each other so as to rotate around the second axis between the opening and closing positions of the closing element;

a slider sliding in the operative chamber along the first axis, the slider comprising a first shaft defining the first axis and an operative head interacting with the pivot, wherein the pivot further includes a cam integrally rotatable therewith, the operative head of the slider comprising an operative face interacting with the cam so that, upon opening or closing the closing element, a rotation of the pivot around the second axis corresponds to the sliding of the slider along the first axis between a stroke start position and a stroke end position, wherein the operative chamber has a first rotation seat for the pivot and a second seat facing the first seat for the sliding of the slider, the hinge body having a first opening to receive, perpendicularly to the first axis, the operative head into the second seat, and a second through opening to receive, coaxially to the first axis, the first shaft into the second seat, wherein the hinge further comprises means for a mutual fixing of the first shaft and the operative head once inserted into the second seat, so as to form a unitary assembly that is integrally joined sliding along the first axis, wherein the hinge further comprises first means and second control means for mechanically controlling the sliding of the slider from one of the start or stroke end positions to another one of the start or stroke end positions and vice versa;

wherein the first control means comprise first elastic counteracting means arranged inside the operative chamber to promote the sliding of the slider from the stroke end position to the stroke start position and to counter the sliding of the slider from the stroke start position to the stroke end position, the first elastic counteracting means being interposed between the operative head of the slider and the bottom wall, and wherein the slider extends through the second through opening so that at least one portion of the slider is outside the operative chamber, the at least one outer portion of the slider having an annular projection, the hinge body having an outer wall facing the annular projection and spaced therefrom, the second control means comprising second elastic counteracting means interposed between the outer wall and the annular projection.

2. The low-bulkiness hinge according to claim 1, further comprising first and second guide means acting on the slider to guide the sliding thereof along the first axis, the first and second guide means being spaced apart along the first axis.

3. The low-bulkiness hinge according to claim 2, wherein the first guide means act on the operative head of the slider and the second guide means act on the shaft.

4. The low-bulkiness hinge according to claim 1, comprising first adjustment means acting on the second control means to adjust a damping of the slider, the first adjustment means being maneuverable by an operator.

5. The low-bulkiness hinge according to claim 1, wherein the second elastic counteracting means comprise a second spring coaxial with the at least one outer portion of the slider, the outer wall of the hinge body comprising a third abutment surface and the annular projection comprising a fourth abutment surface, the second spring being interposed between the third and fourth abutment surfaces.

6. The low-bulkiness hinge according to claim 5, further comprising means for varying a distance between the third and fourth abutment surface when the slider is in the start or stroke end position.

7. The low-bulkiness hinge according to claim 6, further comprising a second shaft operatively coupled with the first shaft so as to slide therewith along the first axis, the second shaft being coupled with or including the third abutment surface, the first shaft and second shaft being mutually screwable so that the mutual screwing or unscrewing decreases or increases the distance to adjust a pre-load of the second elastic counteracting means.

8. The low-bulkiness hinge according to claim 7, wherein the second shaft defines the outer portion of the slider.

9. The low-bulkiness hinge according to claim 1, wherein the first shaft comprises a first shaped portion with a first operative surface, the hinge body comprising a slidable element along a third axis transversal to the first axis, the slidable element comprising a second operative face designed to interact with the first shaped portion so that the sliding of the slider corresponds to a sliding of the slidable element along the third axis, further comprising third elastic counteracting means acting on the slidable element to counter the sliding thereof.

10. The low-bulkiness hinge according to claim 9, wherein the hinge body comprises a circular seat configured to house the slidable element, the circular seat being shaped as a through hole accessible from outside, further comprising a grub screw arranged at the through hole and acting on the third elastic counteracting means to adjust a pre-load thereof.

11. The low-bulkiness hinge according to claim 9, wherein the third elastic counteracting means are a spring or an elastomeric element.

12. The low-bulkiness hinge according to claim 9, wherein the first shaft comprises a longitudinal groove including the first shaped portion and a second portion having a second operative surface substantially coaxial to the first axis so as to allow the sliding of the slider for at least one first portion of the stroke thereof when the second operative face of the slidable element is in contact with the second operative surface and for damping the sliding of the slider for at least one second portion of the stroke when the second operative face of the slidable element is at contact with the first operative surface.

13. The low-bulkiness hinge according to claim 1, further comprising a hydraulic circuit that damps the sliding of the slider between the stroke start and the stroke end position and vice versa, wherein the hinge body comprises a working chamber containing a working fluid and a plunger sealingly inserted into the working chamber to divide the working chamber into a first and one second variable volume compartment, the plunger being operatively connected to the slider so as to slide therewith between a first position, in which the first compartment has minimum volume and the second compartment has maximum volume, and a second position, in which the first compartment has maximum volume and the second compartment has minimum volume, the hydraulic circuit allowing a flow of the working fluid from the first to the second variable volume compartment and vice versa, wherein the slider extends through the second through opening so that at least one portion of the slider is outside the first operative chamber, the outer portion of the slider being operatively connected to the plunger so that the plunger slides with the slider.

14. The low-bulkiness hinge according to claim 13, wherein the first shaft comprises a threaded end defining the outer portion of the slider, further comprising a screw configured to be screwed into the threaded end and a connecting plate interposed between the screw and the first shaft so as to slide integrally joined therewith, the connecting plate being coupled to the plunger so that the plunger slides integrally joined with the first shaft.

* * * * *